US005182074A

United States Patent [19]

Yoshioka et al.

[11] Patent Number: 5,182,074

[45] Date of Patent: Jan. 26, 1993

[54] APPARATUS FOR CONTINUOUSLY COOLING METAL STRIP

[75] Inventors: Osami Yoshioka; Naoki Matsui; Hiroaki Sato; Kouji Omori; Masayuki Yamazaki; Masafumi Suzuki; Hitoshi Oishi; Naoto Kitagawa; Takaya Seike; Yasuhiro Araki, all of Tokyo, Japan

[73] Assignee: NKK Corporation, Tokyo, Japan

[21] Appl. No.: 734,131

[22] Filed: Jul. 22, 1991

[30] Foreign Application Priority Data

Jul. 31, 1990 [JP] Japan ..... 2-202724
Jul. 31, 1990 [JP] Japan ..... 2-202725

[51] Int. Cl.[5] ..... C21D 11/00

[52] U.S. Cl. ..... 266/87; 266/90; 266/103; 266/111

[58] Field of Search ..... 266/87, 103, 109, 90, 266/114, 111

[56] References Cited

FOREIGN PATENT DOCUMENTS 0145485 6/1985 European Pat. Off. ..... 266/109
57-14414 3/1982 Japan .
0255932 12/1985 Japan ..... 266/109
2067125 3/1987 Japan ..... 266/109

*Primary Examiner*—Scott Kastler
*Attorney, Agent, or Firm*—Frishauf, Holtz, Goodman & Woodward

[57] ABSTRACT

An apparatus for continuously cooling a metal strip, which comprises: at least one cooling roll, which is freely rotatable and in contact with a metal strip continuously travelling in the longitudinal direction thereof, for continuously cooling the metal strip, a cooling liquid flowing through the interior of the cooling roll to continuously cool same, a contact area between the surface of the cooling roll and the surface of the metal strip being controllable; and a gas cooler, arranged on the exist side of the at least one cooling roll, for continuously cooling the metal strip by blowing a cooling gas onto the surface of the metal strip so as to achieve a uniform temperature distribution in the width direction of the metal strip after the final cooling thereof, the gas cooler comprising a plurality of mutually independent nozzle headers for blowing the cooling gas onto the surface of the metal strip, and the plurality of nozzle headers controlling at least one of a flow rate and a flow velocity of the cooling gas in the width direction of the metal strip.

20 Claims, 28 Drawing Sheets

APPARATUS FOR CONTINUOUSLY COOLING METAL STRIP

As far as we know, there is available the following prior art document pertinent to the present invention:

Japanese Patent Publication No. 57-14,414 dated Mar. 24, 1982.

The contents of the prior art disclosed in the above-mentioned prior art document will be discussed hereafter under the heading of the "BACKGROUND OF THE INVENTION".

BACKGROUND OF THE INVENTION

1. Field of the Invention

The present invention relates to an apparatus for continuously cooling a metal strip, which is continuously travelling in the longitudinal direction thereof, so as to achieve a uniform temperature distribution in the width direction of the metal strip.

2. Related Art Statement

For example, continuous annealing of a metal strip such as a steel strip is carried out as follows: A metal strip continuously travelling in the longitudinal direction thereof is continuously heated to a prescribed temperature and soaked. Then, the metal strip thus heated and soaked, which is continuously travelling in the longitudinal direction thereof, is continuously cooled to a prescribed temperature at a prescribed cooling rate immediately or after slowly cooling to a prescribed temperature. Then, the metal strip thus cooled is continuously subjected to an overaging treatment or a tempering treatment.

For the purpose of cooling the metal strip in the above-mentioned continuous annealing treatment, the known methods include a water cooling, a gas cooling and a roll cooling. Among these cooling methods, the roll cooling has an advantage of permitting rapid cooling of the metal strip to any temperature. In this respect, the roll cooling is superior to the water cooling and the gas cooling.

As an apparatus for cooling a metal strip by the roll cooling, for example, Japanese Patent Publication No. 57-14,414 dated Mar. 24, 1982 discloses an apparatus for continuously cooling a metal strip, which comprises:

a plurality of cooling rolls, which are freely rotatable and in contact with a metal strip continuously travelling in the longitudinal direction thereof, for continuously cooling said metal strip, each of said plurality of cooling rolls having a length at least equal to the width of the metal strip, said plurality of cooling rolls having axes in parallel with each other, a cooling liquid flowing through the interior of each of said plurality of cooling rolls to continuously cool same, and at least one of said plurality of cooling rolls is displaceable toward said metal strip to control a contact area between the surface of said cooling roll and the surface of said metal strip (hereinafter referred to as the "prior art").

FIG. 41 is a descriptive view illustrating a typical apparatus for continuously cooling a metal strip for example, a steel strip based on the above-mentioned prior art. As shown in FIG. 41, a plurality of cooling rolls 2 comprising, for example, five rolls 2*a* to 2*e*, which are freely rotatable and in contact with a steel strip 1 continuously travelling in the longitudinal direction thereof, for continuously cooling the steel strip, are arranged with the axes thereof in parallel with each other, at prescribed intervals.

Each of the cooling rolls 2 has a length at least equal to the width of the steel strip 1, and a cooling liquid flows through the interior of the cooling roll 2 to continuously cool same. Each of the cooling rolls 2 is displaceable toward the steel strip 1 by a driving mechanism not shown, to control the contact area between the surface of the cooling roll 2 and the surface of the steel strip 1.

The steel strip 1 continuously travels in the arrow direction while coming into contact with each of the above-mentioned plurality of cooling rolls 2. In the meantime, the portion of the surface of the steel strip 1 in contact with the surface of each of the cooling rolls 2 is cooled. The contact area between the surface of the steel strip 1 and the surface of each of the cooling rolls 2 is controlled by causing each of the cooling rolls 2 to displace toward the steel strip 1. The steel strip 1 is thus continuously cooled to a prescribed temperature by the plurality of cooling rolls 2.

The above-mentioned prior art has the following problems: In order to continuously cool the steel strip 1 continuously travelling in the longitudinal direction thereof so as to achieve a uniform temperature distribution in the width direction thereof, it is necessary to bring the surface of the steel strip 1 and the surface of each of the plurality of cooling rolls 2 into close contact with each other uniformly in the width direction of the steel strip 1.

However, it is difficult to bring the surface of the steel strip 1 and the surface of the cooling rolls 2 into close contact with each other uniformly in the width direction of the steel strip 1 for the following reasons:

(1) The steel strip 1, when coming into contact with each of the plurality of cooling rolls 2, is bent into an arcuate shape by each of the plurality of cooling rolls 2, thus resulting in a saddle-shaped deformation of the steel strip 1 in the width direction thereof.

(2) Fluctuations of thickness in the width direction, a defective shape and non-uniform tension in the width direction exist in the steel strip 1.

(3) The contact with the high-temperature steel strip 1 causes occurrence of a roll crown resulting from the thermal deformation in each of the plurality of cooling rolls 2.

(4) The plurality of cooling rolls 2 are non-uniform in the surface roughness.

It therefore becomes particularly difficult for the surfaces of the both side edge portions in the width direction of the steel strip 1 to be in contact with the surface of each of the plurality of cooling rolls 2.

FIG. 42 is a graph illustrating a temperature distribution in the width direction of a steel strip 1, when continuously cooling the steel strip 1 under, for example, the following conditions by means of the cooling apparatus of the prior art as shown in FIG. 41:

(1) Thickness of the steel strip 1: 1.2 mm, (2) Width of the steel strip 1: 1,200 mm, (3) Cooling start temperature of the steel strip 1: about 600° C., (4) Target temperature for cooling of the steel strip 1: 350° C., (5) Chemical composition of the steel strip 1: as shown in Table 1.

TABLE 1

| (wt. %) | | | | | | |
|---|---|---|---|---|---|---|
| C | Si | Mn | P | S | Sol. Al | Fe and incidental impurities |
| 0.015–0.025 | Up to 0.04 | 0.10–0.20 | Up to 0.02 | 0.008–0.025 | 0.032–0.067 | Balance |

In FIG. 42, the abscissa represents a distance from the side edge of the steel strip 1 toward the center in the width direction thereof, and the ordinate represents a temperature in the width direction of the steel strip 1.

As shown in FIG. 42, the temperature in the width direction of the steel strip 1 on the exit side of the cooling roll **2*e* is over the target temperature for cooling of 350° C. in a portion within about 100 mm from the side edge of the steel strip 1, and is about 570° C. at a position, for example, of 20 mm from the side edge of the steel strip 1, and about 350° C. at a position of 100 mm from the side edge thereof. Thus, the temperature distribution in the width direction of the steel strip 1 on the exit side of the cooling roll 2*e* is non-uniform with a higher temperature on the side edge than at the center, the difference in temperature being approximately 220° C. between the center and the side edge. This causes occurrence of a defective shape such as edge waves or heat buckles in the steel strip 1** after the roll cooling.

When the edge waves exist in the side edges of the steel strip 1, an abnormal travelling such as a zigzag motion occurs in the steel strip 1 continuously travelling in the longitudinal direction thereof in the next treatment process such as an overaging treatment process applied to the steel strip 1 after the roll cooling. In an extreme case, as a result, the steel strip 1 is broken, thus making it impossible to continue the operation. It therefore becomes necessary to reduce the travelling speed of the steel strip 1 after the roll cooling in the next treatment process, and this seriously impairs the operational efficiency. When the heat buckles are present in the steel strip 1, the steel strip is rejected as a defective product, thus reducing the product yield.

FIG. 43 is a graph illustrating an aging index (AI) in the width direction of the above-mentioned steel strip 1, when the steel strip 1 is subjected to an overaging treatment at a temperature of 350° C. for two minutes, then to a temper rolling with a reduction of 1.5%, and then, to an aging treatment at a temperature of 100° C. for 60 minutes. In FIG. 43, the abscissa represents a distance from the side edge of the steel strip 1 toward the center in the width direction thereof, and the ordinate represents an aging index (AI).

The higher yield point of the steel strip 1 resulting from the aging causes occurrence of a defective shape and a spring-back during the press-forming and deterioration of a yield point elongation and a buckling resistance of the steel strip 1. The extent of the occurrence of these defects differs in the width direction of the steel strip 1.

In the steel strip 1 having the above-mentioned dimensions and chemical composition, if the upper limit of the aging index (AI) up to which a yield point elongation does not occur during the press-forming is assumed to be, for example, 4 kgf/mm$^2$, then, as is clear from FIG. 43, the portion from the side edge to about 90 mm of the steel strip 1 would have a high aging index of over 4 kgf/mm$^2$. This leads to non-uniform mechanical properties of the steel strip 1 in the width direction thereof.

Under such circumstances, when continuously cooling a metal strip continuously travelling in the longitudinal direction thereof by means of at least one cooling roll, there is a strong demand for the development of an apparatus for continuously cooling a metal strip, which permits prevention of the occurrence of a defective shape such as edge waves or heat buckles in the metal strip and an abnormal travelling of the metal strip such as a zigzag motion in the next process, and makes available a high-quality metal strip having uniform mechanical properties in the width direction thereof through achievement of a uniform temperature distribution in the width direction of the metal strip, but such an apparatus has not as yet been proposed.

SUMMARY OF THE INVENTION

An object of the present invention is therefore to provide, when continuously cooling a metal strip continuously travelling in the longitudinal direction thereof by means of at least one cooling roll, an apparatus for continuously cooling a metal strip, which permits prevention of the occurrence of a defective shape such as edge waves or heat buckles in the metal strip and an abnormal travelling of the metal strip such as a zigzag motion in the next process, and makes available a high-quality metal strip having uniform mechanical properties in the width direction thereof, through achievement of a uniform temperature distribution in the width direction of the metal strip.

In accordance with one of the features of the present invention there is provided an apparatus for continuously cooling a metal strip, which comprises:

at least one cooling roll, which is freely rotatable and in contact with a metal strip continuously travelling in the longitudinal direction thereof, for continuously cooling said metal strip, said cooling roll having a length at least equal to the width of said metal strip, a cooling liquid flowing through the interior of said cooling roll to continuously cool same, and a contact area between the surface of said cooling roll and the surface of said metal strip being controllable; and a gas cooler, arranged on the exit side of said at least one cooling roll, for continuously cooling said metal strip by blowing a cooling gas onto the surface of said metal strip so as to achieve a uniform temperature distribution in the width direction of said metal strip after the final cooling thereof, said gas cooler being arranged in the width direction of said metal strip at a prescribed distance from each of the both surfaces of said metal strip, said gas cooler comprising a plurality of mutually independent nozzle headers for blowing said cooling gas onto the surface of said metal strip, and said plurality of nozzle headers controlling at least one of a flow rate and a flow velocity of said cooling gas in the width direction of said metal strip.

DETAILED DESCRIPTION OF PREFERRED EMBODIMENTS

From the above-mentioned point of view, extensive studies were carried out to develop an apparatus for continuously cooling a metal strip, which permits, when continuously cooling the metal strip continuously travelling in the longitudinal direction thereof by means of at least one cooling roll, prevention of the occurrence of a defective shape such as edge waves or heat buckles in the metal strip and an abnormal travelling of the metal strip such as a zigzag motion in the next process, and makes available a high-quality metal strip having uniform mechanical properties in the width direction thereof, through achievement of a uniform temperature distribution in the width direction of the metal strip.

As a result, the following findings were obtained: A defective shape such as edge waves or heat buckles and an abnormal travelling such as a zigzag motion in the next process never occur in the metal strip, by arranging a gas cooler on the exit side of the above-mentioned at least one cooling roll for continuously cooling the travelling metal strip; and blowing a cooling gas from the gas cooler onto the surface of the metal strip, which has been cooled by means of the at least one cooling roll, to further continuously cool the metal strip so as to achieve a uniform temperature distribution in the width direction of the metal strip after the final cooling thereof.

The present invention was made on the basis of the above-mentioned findings. The apparatus of the present invention is described below with reference to the drawings as to the cooling of a steel strip.

Figure 1:
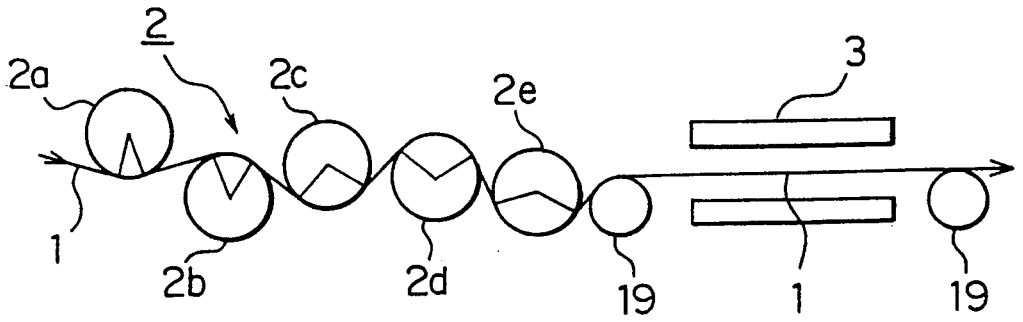
FIG. 1 is a descriptive view illustrating a first embodiment of the apparatus of the present invention.

FIG. 1 is a descriptive view illustrating a first embodiment of the apparatus of the present invention. As shown in FIG. 1, the apparatus of the first embodiment comprises a plurality of cooling rolls 2, which the freely rotatable and in contact with a steel strip 1 continuously travelling in the longitudinal direction thereof, for continuously cooling the steel strip 1, and a gas cooler 3, arranged on the exit side of the plurality of cooling rolls 2, for continuously cooling the steel strip 1 by blowing a cooling gas onto the surface of the steel strip 1 so as to achieve a uniform temperature distribution in the width direction of the steel strip 1 after the final cooling thereof. Also in FIG. 1, 19 are deflector rolls, each installed on each of the entry side and the exit side of the gas cooler 3, for keeping a clearance of the steel strip 1 travelling through the gas cooler 3 from the gas cooler 3.

The plurality of cooling rolls 2 are arranged with the axes thereof in parallel with each other at prescribed intervals. Each of the plurality of cooling rolls 2 has a length at least equal to the width of the steel strip 1. A cooling liquid flows through the interior of each of the cooling rolls 2 to continuously cool same. Each of the plurality of cooling rolls 2 is displaceable toward the steel strip 1 by a driving mechanism not shown to control the contact area between the surface of each of the cooling rolls 2 and the surface of the steel strip 1.

Figure 2:
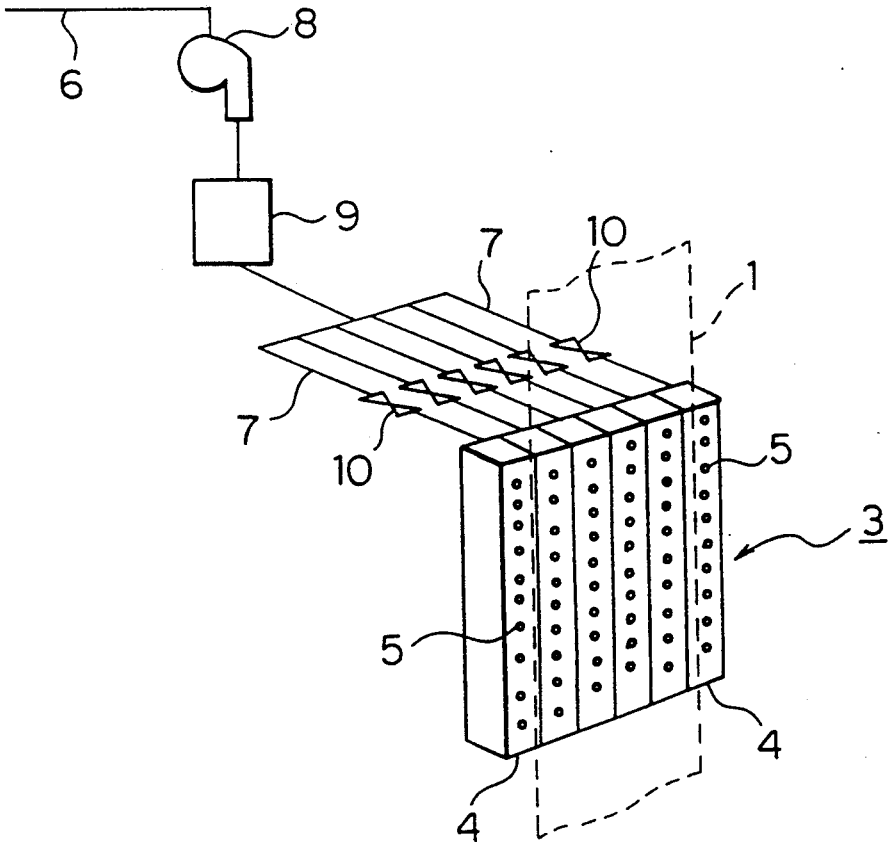
FIG. 2 is a schematic perspective view illustrating a typical gas cooler used in the apparatus of the present invention.

The gas cooler 3 is arranged in the width direction of the steel strip 1 at a prescribed distance from each of the both surfaces of the steel strip 1 continuously travelling in the longitudinal direction thereof. FIG. 2 is a schematic perspective view illustrating a typical gas cooler used in the apparatus of the present invention.

As shown in FIG. 2, the gas cooler 3 comprises a plurality of mutually independent nozzle headers 4 for blowing the cooling gas onto the surface of the steel strip 1. The plurality of nozzle headers 4 control at least one of the flow rate and the flow velocity of the cooling gas. Each of the plurality of nozzle headers 4 has a plurality of nozzles 5 provided at prescribed intervals in the longitudinal direction of the nozzle header 4. The nozzle 5, which is hole-shaped in FIG. 2, may be slit-shaped.

In FIG. 2, 6 is a duct for supplying a cooling gas from a cooling gas reservoir not shown to each of the nozzle headers 4. Each of a plurality of branch pipes 7 branching from the duct 6 is connected to each of the plurality of headers 4. A blower 8 and a cooler 9 for cooling the cooling gas flowing through the duct 6 are provided in the middle of the duct 6, and a control valve 10 is provided in the middle of each of the branch pipes 7.

Figure 3:
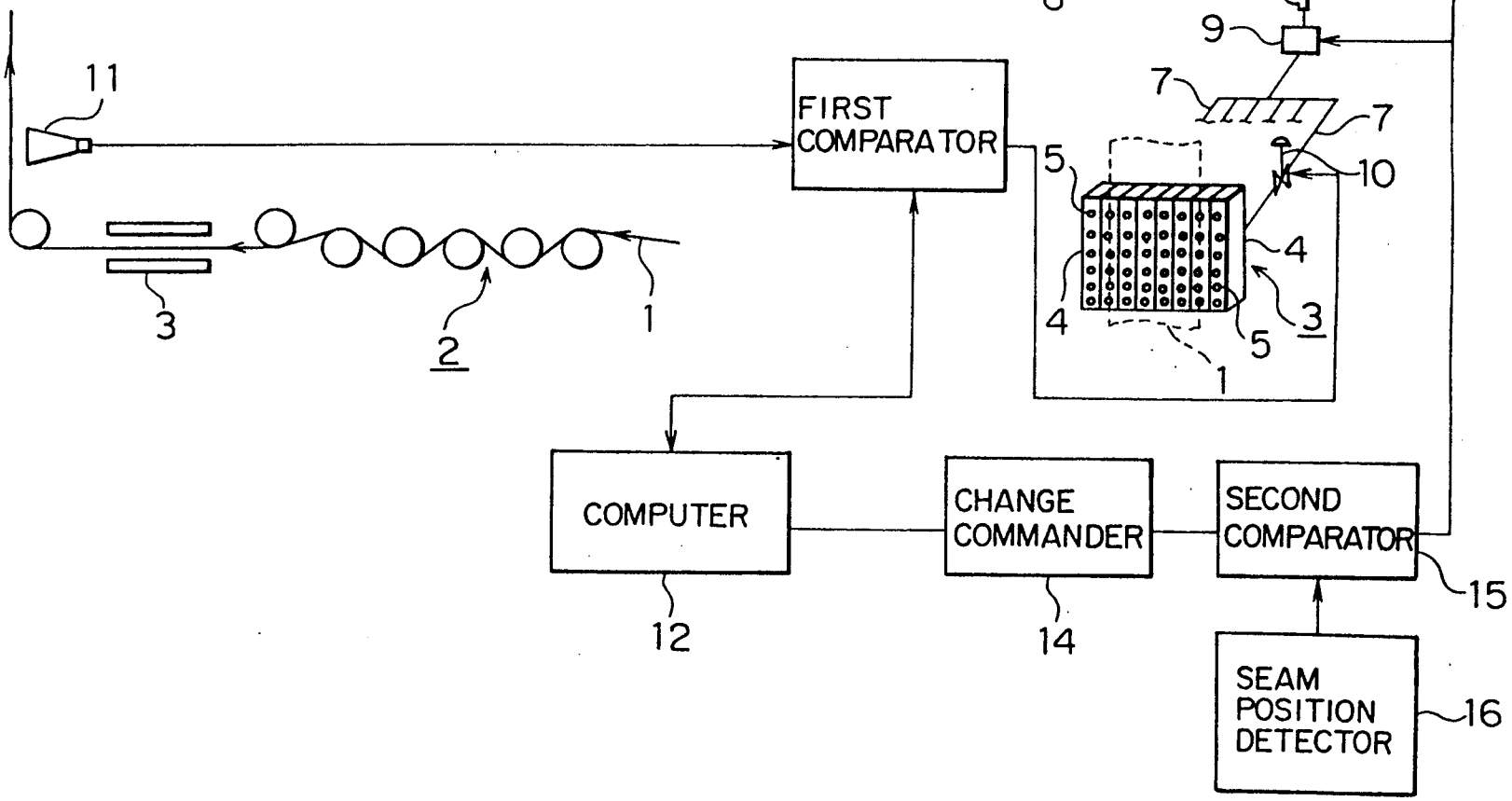
FIG. 3 is a flow diagram illustrating a typical cooling system using the apparatus of the first embodiment of the present invention.

FIG. 3 is a flow diagram illustrating a typical cooling system using the apparatus of the first embodiment of the present invention. As shown in FIG. 3, a thermometer 11 for continuously measuring a temperature distribution in the width direction of the steel strip 1 after the final cooling thereof, is provided on the exit side of the gas cooler 3. Target temperatures in the width direction of the steel strip 1 after the final cooling are stored in a computer 12.

The thermometer 11 continuously measures the temperature distribution in the width direction of the steel strip 1 after the final cooling, and transmits the result of measurement to a first comparator 13. The first comparator 13 compares the result of measurement transmitted from the thermometer 11 with the target temperature in the width direction of the steel strip 1 after the final cooling transmitted from the computer 12, and calculates the difference therebetween.

The first comparator 13 transmits a signal for controlling at least one of a flow rate and a flow velocity of the cooling gas in the width direction of the steel strip 1 to the control valve 10 provided in the middle of each of the plurality of branch pipes 7 so that the difference as calculated above becomes null. At least one of the flow rate and the flow velocity of the cooling gas blown from each of the plurality of nozzle headers 4 of the gas cooler 3 onto the surface of the steel strip 1 is thus controlled in the width direction of the steel strip 1 so as to achieve a uniform temperature distribution in the width direction of the steel strip 1 after the final cooling.

The computer 12 stores also cooling conditions by the gas cooler 3 for each of the thickness, the heat treatment cycle and the travelling speed of the steel strip 1. When there is a change in any of the thickness, the heat treatment cycle (including a cooling start temperature, a cooling rate and a target temperature for cooling) and the travelling speed of the steel strip 1, a change commander 14 transmits a change signal of the cooling conditions to a second comparator 15 based on a signal from the computer 12. A seam position detector 16 detects, on the other hand, a seam position of the steel strip 1, for which the thickness or the travelling speed has been changed, and transmits a detection signal to the second comparator 15. On the basis of the detection signal from the seam position detector 16, the second comparator 15 transmits a signal to the blower 8 and the cooler 9 to control at least one of the flow rate and the flow velocity of the cooling gas blown by the blower 8 and the cooling conditions of the cooling gas by the cooler 9. This regulates the amount of cooling as a while for the steel strip 1 by the gas cooler 3.

Figure 4:
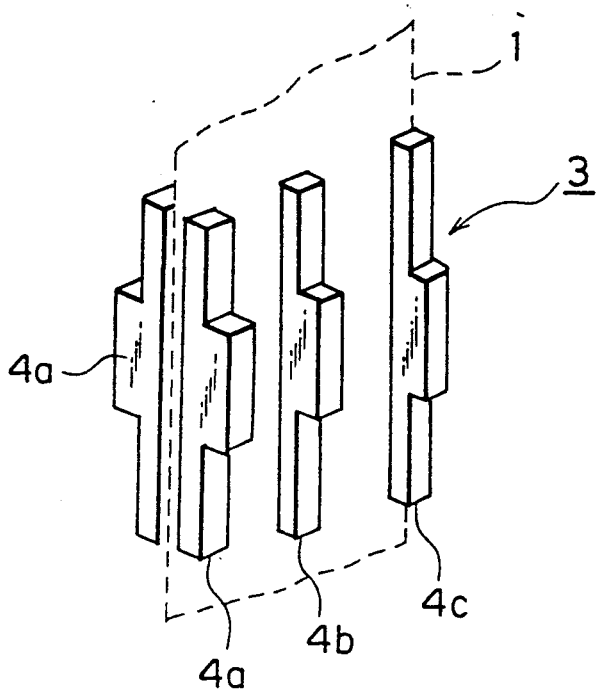
FIG. 4 is a schematic perspective view illustrating another typical gas cooler used in the apparatus of the present invention.

FIG. 4 is a schematic perspective view illustrating another typical gas cooler used in the apparatus of the present invention. As shown in FIG. 4, the gas cooler 3 may comprise, for example, three nozzle headers 4*a*, 4*b* and 4*c*, which are selectively movable in the width direction of the steel strip 1. When the gas cooler 3 has such a construction, it is possible to cope with a change in the width of the steel strip 1 or a zigzag motion of the steel strip 1.

Figure 5:
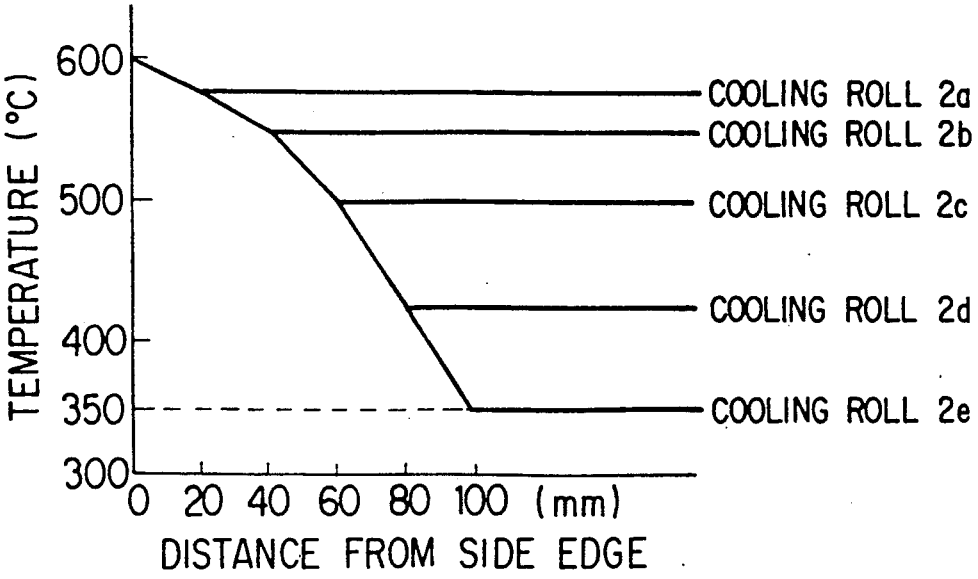
FIG. 5 is a graph illustrating a temperature distribution of a steel strip in the width direction thereof when continuously cooling the steel strip by means of the apparatus of the first embodiment of the present invention.

FIG. 5 is a graph illustrating a temperature distribution of a steel strip in the width direction thereof, having, for example, a thickness of 1.2 mm, a width of 1,200 mm, and the chemical composition as shown in the above-mentioned Table 1, when continuously cooling the steel strip 1 from the cooling start temperature of about 600° C. to the target temperature for cooling of 350° C. by means of the apparatus of the first embodiment of the present invention as shown in FIG. 1. In FIG. 5, the abscissa represents a distance from the side edge of the steel strip 1 toward the center in the width direction thereof, and the ordinate represents a temperature in the width direction of the steel strip 1. Also in FIG. 5, the solid line represents the temperature of the steel strip 1 on the exit side of each of the five cooling rolls 2*a* to 2*e*, and the dotted line represents the temperature of the steel strip 1 on the exit side of the gas cooler 3.

As shown by the solid line in FIG. 5, the temperature of the steel strip 1 in the width direction thereof on the exit side of the cooling roll 2*e* is over the target temperature for cooling of 350° C. in a portion within about 100 mm from the side edge of the steel strip 1, and is about 570° C. at a position, for example, of 20 mm from the side edge of the steel strip 1. On the exit side of the gas cooler 3, however, the steel strip 1 shows a uniform temperature of about 350° C. over the entire portion from the side edge to the center of the steel strip 1, as shown by the dotted line in FIG. 5.

Figure 6:
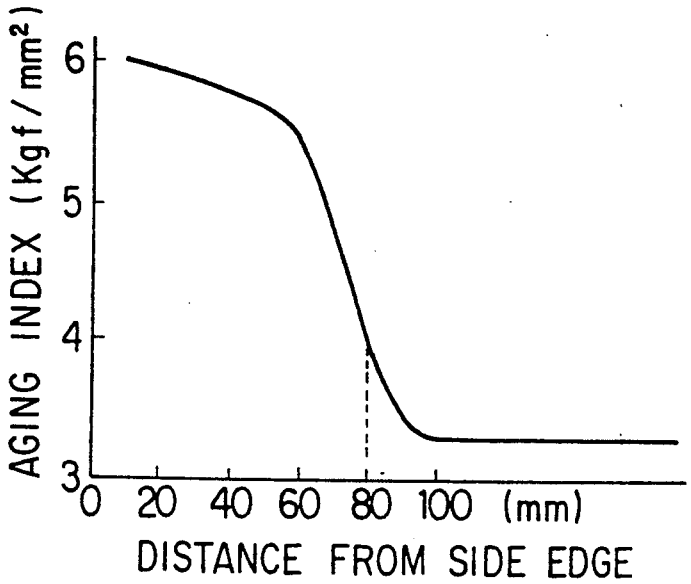
FIG. 6 is a graph illustrating an aging index (AI) of a steel strip in the width direction thereof, when continuously cooling the steel strip by means of the apparatus of the first embodiment of the present invention.

FIG. 6 is a graph illustrating an aging index (AI) of the above-mentioned steel strip 1 in the width direction thereof. In FIG. 6, the abscissa represents a distance from the side edge of the steel strip 1 toward the center in the width direction thereof, and the ordinate represents an aging index (AI). As is clear from FIG. 6, the portion showing an aging index of over 4 kgf/mm$^2$ covers a distance of only about 80 mm from the side edge of the steel strip 1, thus the portion having an aging index of over 4 Kgf/mm$^2$ is reduced.

Figure 7:
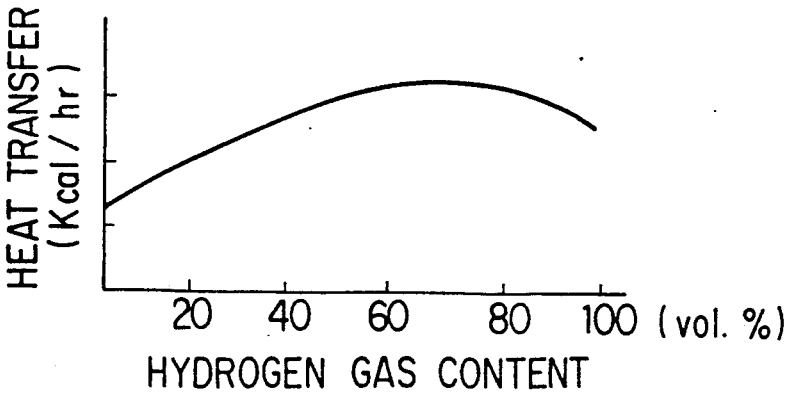
FIG. 7 is a graph illustrating the relationship between a hydrogen gas content in the cooling gas used in the apparatus of the present invention and an amount of heat transfer per unit time of the cooling gas.

As the cooling gas, it is desirable to use a mixed gas, which comprises a hydrogen gas of from 40 to 90 vol. % and a nitrogen gas of from 10 to 60 vol. %, and has a large amount of heat transfer per unit time. FIG. 7 is a graph illustrating, in a cooling gas comprising a mixed gas of hydrogen gas and nitrogen gas, the relationship between a hydrogen gas content in the cooling gas and an amount of heat transfer per unit time of the cooling gas. As is clear from FIG. 7, a hydrogen gas content in the above-mentioned cooling gas of under 40 vol. % or over 90 vol. % leads to a decreased amount of heat transfer per unit time of the cooling gas. The most desirable hydrogen gas content in the cooling gas is about 70 vol. %.

The hydrogen gas content in the cooling gas is adjusted when changing the thickness, the heat treatment cycle or the travelling speed of the steel strip 1. As required, the hydrogen gas content in the cooling gas may be changed in the width direction of the steel strip 1 so as to control the cooling conditions in the width direction of the steel strip 1. A helium gas may be used in place of a hydrogen gas.

Figure 8:
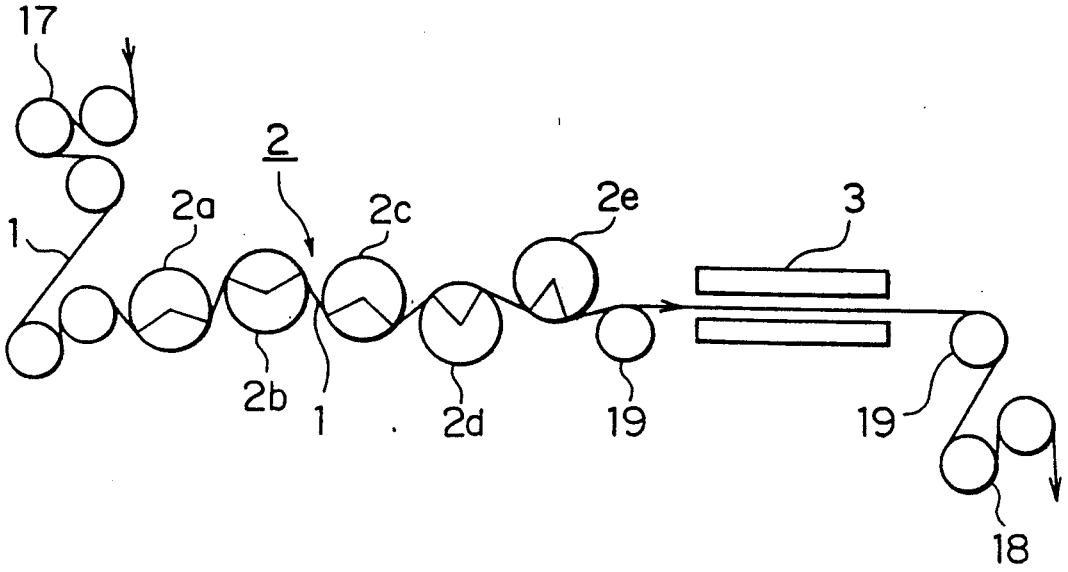
FIG. 8 is a descriptive view illustrating a second embodiment of the apparatus of the present invention.

FIG. 8 is a descriptive view illustrating a second embodiment of the apparatus of the present invention. As shown in FIG. 8, the apparatus of the second embodiment comprises a plurality of cooling rolls 2, which are freely rotatable and in contact with a steel strip 1 continuously travelling in the longitudinal direction thereof, for continuously cooling the steel strip 1, a gas cooler 3, arranged on the exit side of the plurality of cooling rolls 2, for continuously cooling the steel strip 1 by blowing a cooling gas onto the surface of the steel strip 1 so as to achieve a uniform temperature distribution in the width direction of the steel strip 1 after the final cooling thereof, a first tension regulator 17, comprising at least two bridle rolls, arranged on the entry side of the plurality of cooling rolls 2, and a second tension regulator 18, comprising at least two bridle rolls, arranged on the exit side of the gas cooler 3. In FIG. 8, 19 are deflector rolls, each installed on each of the entry side and the exit side of the gas cooler 3, for keeping a clearance of the steel strip 1 travelling through the gas cooler 3 from the gas cooler 3.

In the apparatus of the second embodiment, as described above, the first tension regulator 17 is arranged on the entry side of the plurality of cooling rolls, and the second tension regulator is arranged on the exit side of the gas cooler 3. A desired tension is therefore imparted to the steel strip 1 continuously travelling through the plurality of cooling rolls 2 and the gas cooler 3. This minimizes occurrences of a defective contact between the surface of the steel strip 1 and the surface of each of the plurality of cooling rolls 2, and occurrences of scratches caused by the contact with the gas cooler 3 upon passing through the gas cooler 3.

Figure 9:
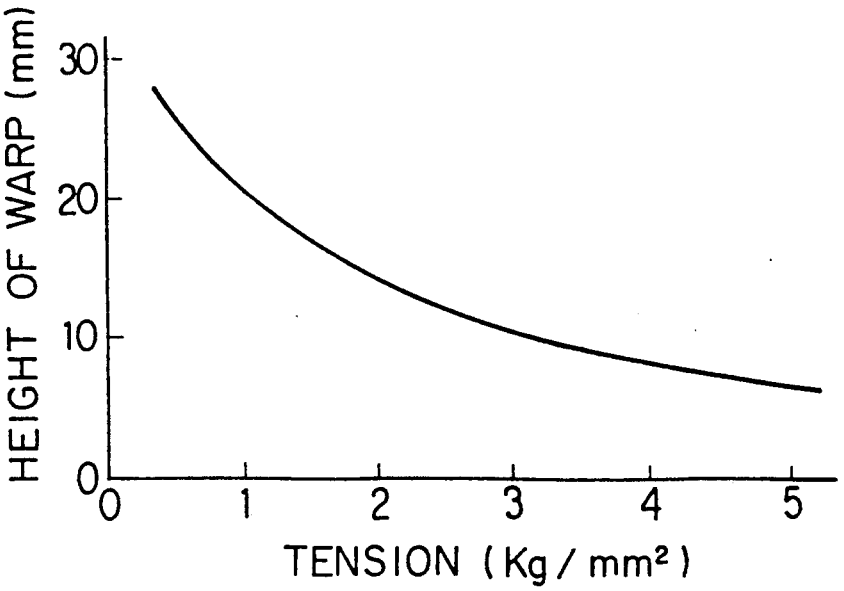
FIG. 9 is a graph illustrating the relationship between a tension of the steel strip travelling through the cooling roll and a height of warp of the steel strip at the side edge portion in the width direction thereof from the surface of the cooling roll.

FIG. 9 is a graph illustrating the relationship between a tension of the steel strip 1 continuously travelling while coming into contact with each of the plurality of cooling rolls 2 and a height of warp of the steel strip 1 at the side edge portion in the width direction thereof from the surface of each of the cooling rolls 2. With a tension of at least 3 kg/mm$^2$ of the steel strip 1 continuously travelling, as is clear from FIG. 9, it is possible to reduce the height of warp of the steel strip 1 at the side edge portion in the width direction thereof from the surface of each of the cooling rolls 2 to up to 10 mm.

Figure 10:
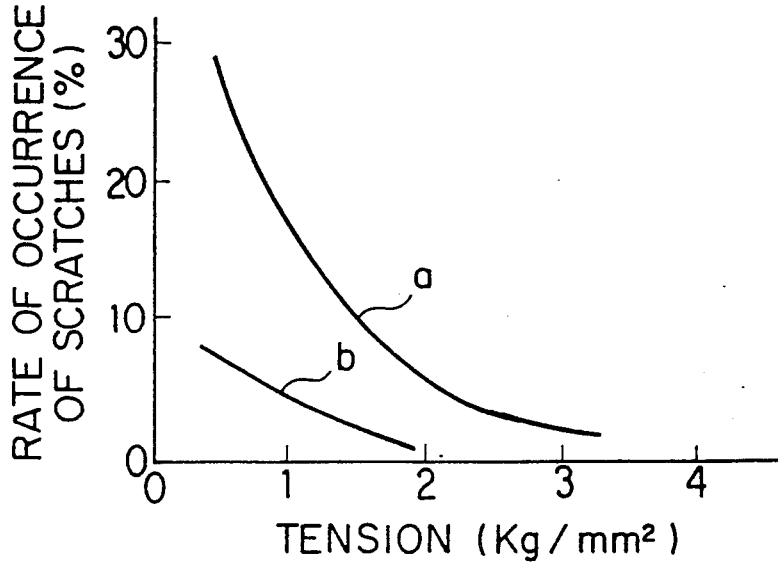
FIG. 10 is a graph illustrating the relationship between a tension of the steel strip travelling through the gas cooler and a rate of occurrence of scratches on the steel strip.

FIG. 10 is a graph illustrating the relationship between a tension of the steel strip 1 continuously travelling through the gas cooler 3 and a rate of occurrence of scratches on the steel strip 1 caused by the contact between the steel strip 1 and the gas cooler 3. In FIG. 10, the curve "a" represents the rate of occurrence of scratches with a clearance of 75 mm between the steel strip 1 and the gas cooler 3, and the curve "b" represents the rate of occurrence of scratches with a clearance of 150 mm between the steel strip 1 and the gas cooler 3. As is clear from FIG. 10, the rate of occurrence of scratches on the steel strip 1 is reduced according as the tension of the continuously travelling steel strip 1 becomes higher.

As shown in FIG. 8, the contact area between the surface of the steel strip 1 and the surface of each of the first-half cooling rolls *2a, 2b* and *2c* from among the plurality of cooling rolls 2 should preferably be larger than the contact area between the surfaces of the steel strip 1 and the surface of each of the latter-half cooling rolls *2d* and *2e* from among the plurality of cooling rolls 2. The contact area between the surface of the steel strip 1 and the surface of each of the plurality of cooling rolls 2 can be controlled by causing each of the plurality of cooling rolls 2 to displace toward the steel strip 1.

Figure 11:
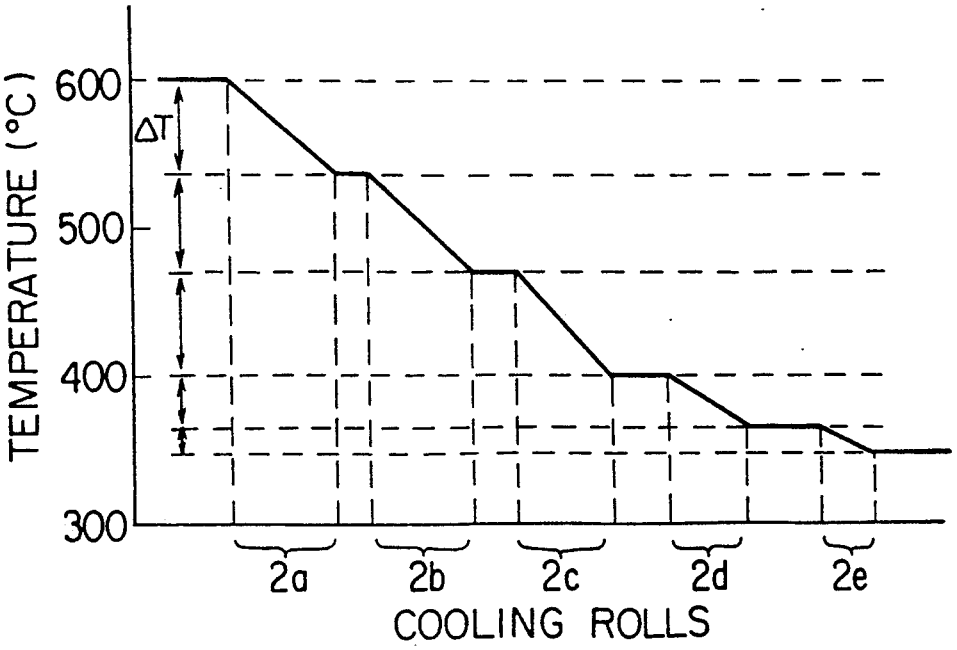
FIG. 11 is a graph illustrating an amount of temperature drop of the steel strip at each of the plurality of cooling rolls, when continuously cooling the steel strip by means of the apparatus of the second embodiment of the present invention.

FIG. 11 is a graph illustrating an amount of temperature drop of the steel strip 1 at each of the plurality of cooling rolls *2a, 2b, 2c, 2d* and *2e*, when continuously cooling the steel strip 1 by means of the apparatus of the second embodiment of the present invention as shown in FIG. 8. As shown in FIG. 11, a larger contact area between the surface of the steel strip 1 and the surface of each of the first-half cooling rolls *2a, 2b* and *2c* results in a large amount of temperature drop ($\Delta T$) of the steel strip 1 at each of the first-half cooling rolls *2a, 2b* and *2c*. This reduces the degree of unevenness of the temperature distribution in the width direction of the steel strip 1 on the exit side of the cooling roll *2e*.

The reason is as follows: Upon contact of the steel strip 1 with each of the plurality of cooling rolls 2, a saddle-shaped deformation occurs in the width direction of the steel strip 1, as described before. Such a saddle-shaped deformation occurs, for the cooling roll *2a*, within very limited portions of the both side edges of the steel strip 1. However, when the steel strip 1 sequentially comes into contact with each of the cooling rolls *2b* to *2e*, the range of occurrence of the saddle-shaped deformation expands in the width direction of the steel strip 1. The both side edge portions in the width direction of the steel strip 1 on the exit side of the cooling roll *2e* therefore form a large warp apart from the surface of the cooling roll *2e*, and thus, the both side edge portions of the steel strip 1 have a higher temperature than that of the center portion thereof.

Therefore, it is possible to inhibit the increase of deformations in the width direction of the steel strip 1 and thus to prevent propagation of the above-mentioned warp to the center portion of the steel strip 1, by increasing the contact area between the surface of the steel strip 1 and the surface of each of the first-half cooling rolls *2a, 2b* and *2c*, which have a relatively limited range of occurrence of the saddle-shaped deformations, and thus increasing the amount of temperature drop of the steel strip 1 at the first-half cooling rolls *2a, 2b* and *2c*.

This reduces the non-uniformity of the temperature distribution in the width direction of the steel strip 1 on the exit side of the cooling roll *2e*. Alternatively, the contact area between the surface of the steel strip 1 and the surface of each of the plurality of cooling rolls *2a, 2b, 2c, 2d* and *2e* may be gradually increased from the downstream cooling roll *2e* toward the upstream cooling roll *2a*.

Figure 12:
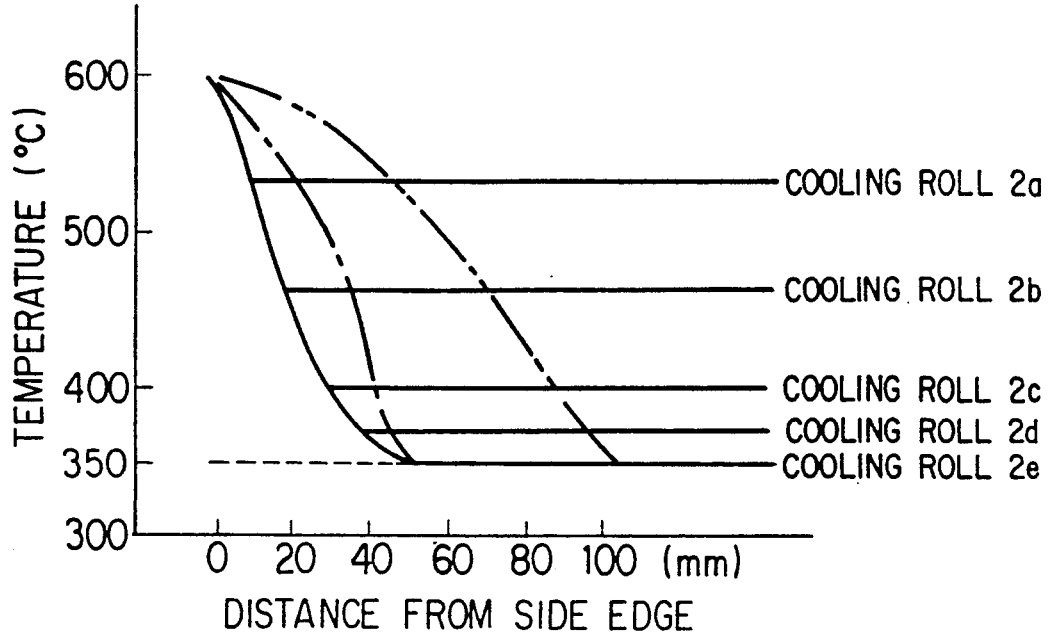
FIG. 12 is a graph illustrating a temperature distribution of a steel strip in the width direction thereof, when continuously cooling the steel strip by means of the apparatus of the second embodiment of the present invention.

FIG. 12 is a graph illustrating a temperature distribution of a steel strip 1 in the width direction thereof, when continuously cooling the steel strip 1 under the same conditions as in the first embodiment by means of the apparatus of the second embodiment of the present invention as shown FIG. 8. In FIG. 12, the abscissa represents a distance from the side edge of the steel strip 1 toward the center in the width direction thereof, and the ordinate represents a temperature in the width direction of the steel strip 1. As shown by the solid line in FIG. 12, the temperature of the steel strip 1 in the width direction thereof on the exit side of the cooling roll *2e* is over the target temperature for cooling of 350° C. in a portion within about 50 mm from the side edge of the steel strip 1, and is about 480° C. at a position, for example, of 20 mm from the side edge of the steel strip 1. On the exit side of the gas cooler 3, however, the steel strip 1 shows a uniform temperature of about 350° C. over the entire portion from the side edge to the center of the steel strip 1, as shown by the dotted line in FIG. 12.

The two-point chain line in FIG. 12 represents a temperature distribution in the width direction of a steel strip 1, when continuously cooling the steel strip 1 by means of the above-mentioned prior art, i.e., by means of the plurality of cooling rolls 2 alone. The one-point chain line in FIG. 12 represents a temperature distribution in the width direction of a steel strip 1, when continuously cooling the steel strip 1 by means of the plurality of cooling rolls 2 alone, with however two tension regulators each provided on the entry side and the exit side of the plurality of cooling rolls 2. As is clear from FIG. 12, cooling of the steel strip 1 by means of the apparatus of the second embodiment of the present invention permits achievement of a uniform temperature distribution in the width direction of the steel strip 1 as compared with the prior art.

Figure 13:
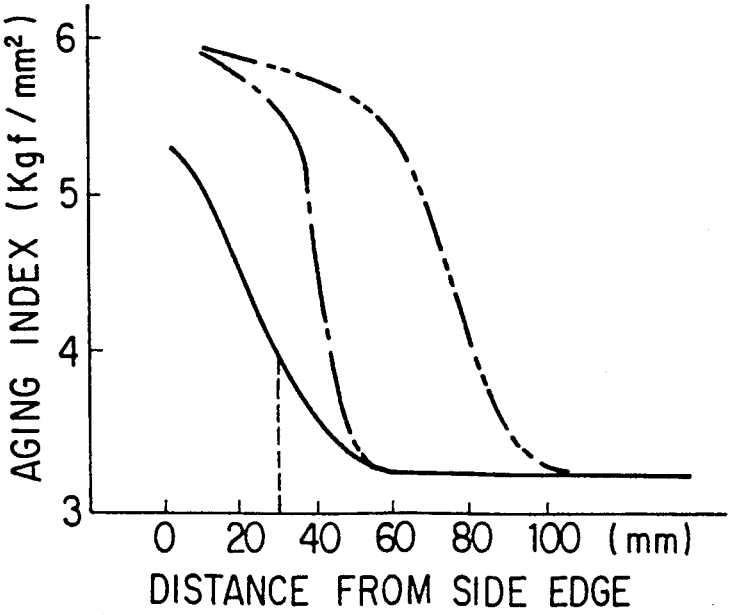
FIG. 13 is a graph illustrating an aging index (AI) of a steel strip in the width direction thereof, when continuously cooling the steel strip by means of the apparatus of the second embodiment of the present invention.

FIG. 13 is a graph illustrating an aging index (AI) of the above-mentioned steel strip 1 in the width direction thereof. In FIG. 13, the abscissa represents a distance from the side edge of the steel strip 1 toward the center in the width direction thereof, and the ordinate represents an aging index (AI). As is evident from FIG. 13, the portion showing an aging index of over 4 $kgf/mm^2$ covers only about 30 mm from the side edge of the steel strip 1, thus the portion having an aging index of over 4 $kgf/mm^2$ is remarkably reduced. The two-point chain line in FIG. 13 represents an aging index in the width direction of a steel strip 1, when continuously cooling the steel strip 1 by means of the above-mentioned prior art, i.e., by means of the plurality of cooling rolls 2 alone. The one-point chain line in FIG. 13 represents an aging index in the width direction of a steel strip 1, when continuously cooling the steel strip 1 by means of the plurality of cooling rolls 2 alone, with however, two tension regulators each provided on the entry side and the exit side of the plurality of cooling rolls 2. As is clear from FIG. 13, cooling of the steel strip 1 by means of the apparatus of the second embodiment of the present invention permits achievement of a uniform aging index in the width direction of the steel strip 1 as compared with the prior art.

Figure 14:
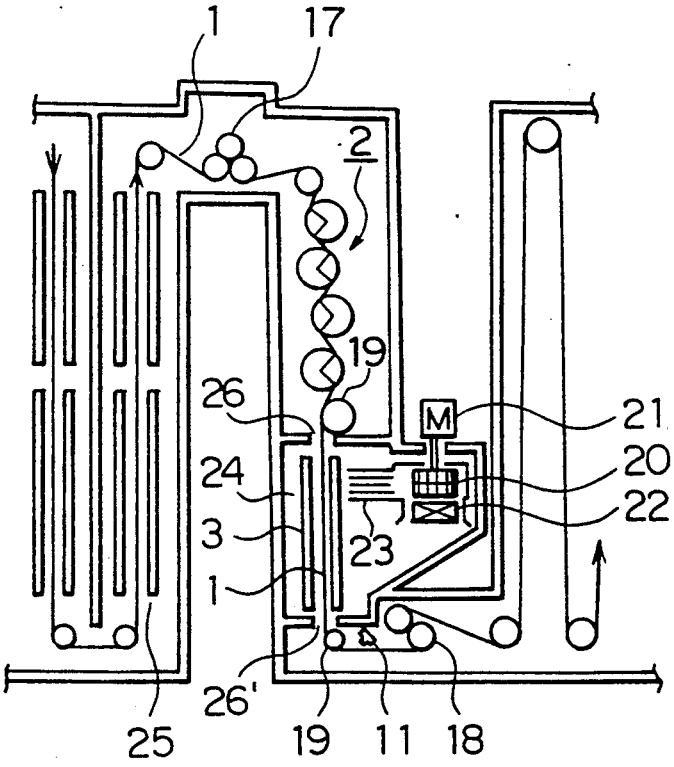
FIG. 14 is a schematic side view illustrating a typical apparatus of the second embodiment of the present invention.

FIG. 14 is a schematic side view illustrating a typical apparatus of the second embodiment of the present invention. As shown in FIG. 14, the first tension regulator 17 comprising at least two bridle rolls is arranged on the entry side of the plurality of cooling rolls 2, and the second tension regulator 18 comprising at least two bridle rolls is arranged on the exit side of the gas cooler 3. A thermometer 11 for continuously measuring a temperature distribution in the width direction of the steel strip 1 after the final cooling thereof, is provided on the exit side of the gas cooler 3. The deflector roll 19 is provided on each of the entry side and the exit side of the gas cooler 3.

In FIG. 14, 20 is a blower, driven by a motor 21, for blowing a cooling gas through a duct 23 into the gas cooler 3, and 22 is a cooler for cooling the cooling gas. In order to avoid the danger of a gas explosion when using a mixed gas containing a hydrogen gas in a large quantity, the blower 20, the cooler 22, the duct 23 and the gas cooler 3 are housed in a gas cooling chamber 24. Slots 26 and 26' for passing the steel strip 1 are provided on each of the entry side and the exit side of the gas cooling chamber 24. A dumper not shown is provided in the middle of the duct 23, for controlling at least one of the flow rate and the flow velocity of the cooling gas in the width direction of the steel strip 1.

As shown in FIG. 14, the steel strip 1 continuously travelling in the longitudinal direction thereof, which has been slowly cooled to a prescribed temperature in a preliminary gas cooling zone 25, is introduced through the first tension regulator 17 to the plurality of cooling rolls 2. The steel strip 1 is then cooled by the contact with each of the plurality of cooling rolls 2. Then, the steel strip 1 is introduced through a slot 26 into the gas cooling chamber 24. The steel strip 1 is cooled in the gas cooler 3 in the gas cooling chamber 24 so as to achieve a uniform temperature distribution in the width direction of the steel strip 1 after the final cooling thereof. The steel strip 1 cooled in the gas cooler 3 leaves the gas cooling chamber 24 through another slot 26' and directed through the second tension regulator 18 to the next treatment process.

On the basis of the temperature distribution in the width direction of the steel strip 1 after the final cooling, as measured by the thermometer 11, at least one of the flow rate and the flow velocity of the cooling gas which is blown onto the surface of the steel strip 1 is controlled by the dumper not shown, provided in the middle of the duct 23.

Figure 15:
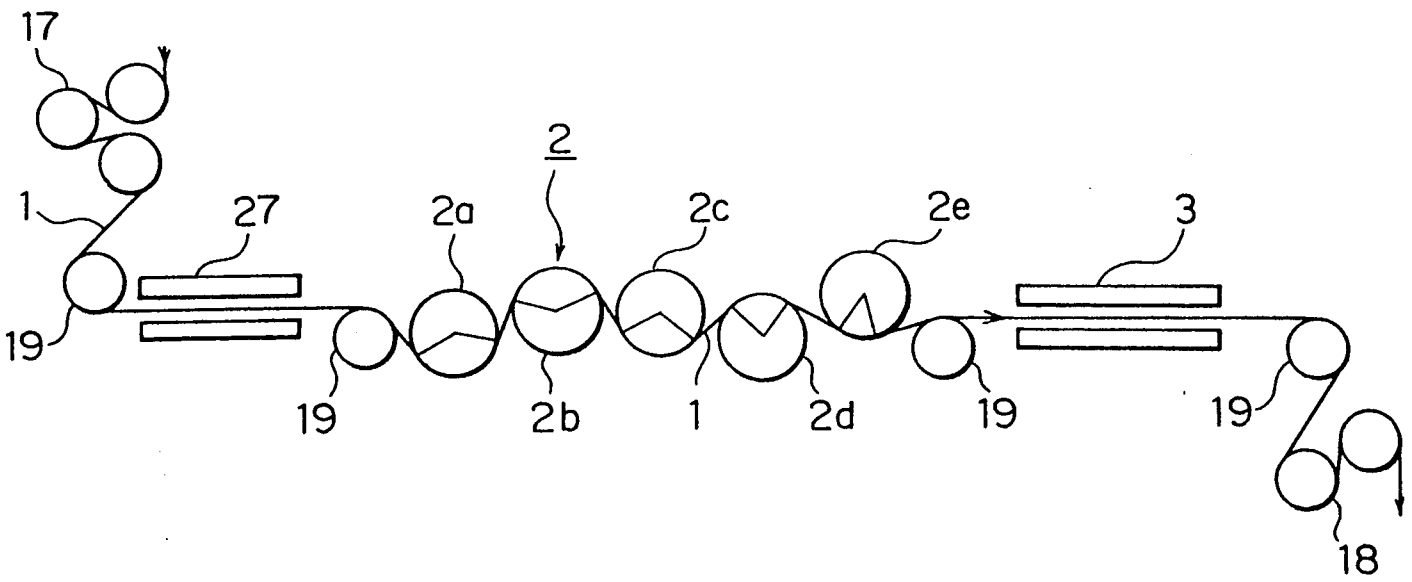
FIG. 15 is a descriptive view illustrating a third embodiment of the apparatus of the present invention.

FIG. 15 is a descriptive view illustrating a third embodiment of the apparatus of the present invention. As shown in FIG. 15, the apparatus of the third embodiment is identical with the apparatus of the second embodiment shown in FIG. 8, except that another gas cooler 27 for continuously cooling the steel strip 1 by blowing a cooling gas onto the surface of the steel strip 1 so as to achieve a uniform temperature distribution in the width direction of the steel strip 1 after the final cooling thereof, is arranged between the first tension regulator 17 and the plurality of cooling rolls 2.

Figure 16:
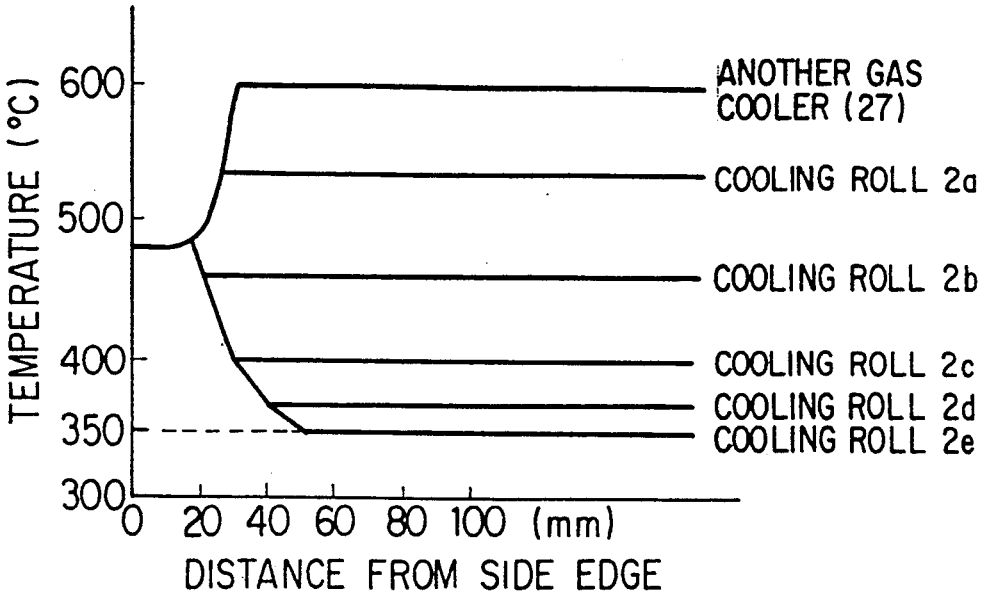
FIG. 16 is a graph illustrating a temperature, distribution of a steel strip in the width direction thereof, when continuously cooling the steel strip by means of the apparatus of the third embodiment of the present invention.

FIG. 16 is a graph illustrating a temperature distribution of a steel strip 1 in the width direction thereof, when continuously cooling the steel strip 1 under the same conditions as in the first embodiment by means of the apparatus of the third embodiment of the present invention as shown in FIG. 15. In FIG. 16, the abscissa represents a distance from the side edge of the steel strip 1 toward the center in the width direction thereof, and the ordinate represents a temperature in the width direction of the steel strip 1. As shown by the solid line in FIG. 16, the temperature of the steel strip 1 in the width direction thereof on the exit side of the cooling roll 2*e* is over the target temperature for cooling of 350° C. in a portion within about 50 mm from the side edge of the steel strip 1. On the exit side of the gas cooler 3, however, the steel strip 1 shows a uniform temperature of about 350° C. over the entire portion from the side edge to the center of the steel strip 1, as shown by the dotted line in FIG. 16.

Figure 17:
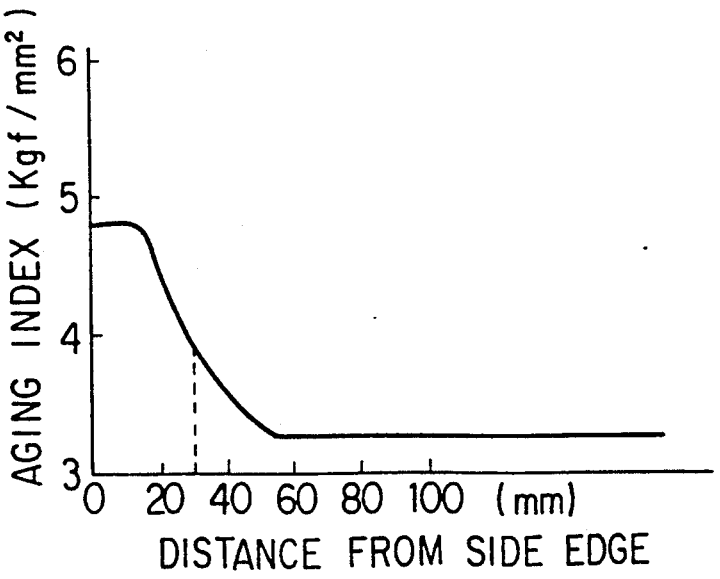
FIG. 17 is a graph illustrating an aging index (AI) of a steel strip in the width direction thereof, when continuously cooling the steel strip by means of the apparatus of the third embodiment of the present invention.

FIG. 17 is a graph illustrating an aging index (AI) of the above-mentioned steel strip 1 in the width direction thereof. In FIG. 17 the abscissa represents a distance from the side edge of the steel strip 1 toward the center in the width direction thereof, and the ordinate represents an aging index (AI). As is clear from FIG. 17, the portion showing an aging index of over 4 kgf/mm$^2$ covers only about 30 mm from the side edge of the steel strip 1, with a maximum aging index of 4.8 kgf/mm$^2$, thus the portion having an aging index of over 4 kgf/mm$^2$ is remarkably reduced.

Figure 18:
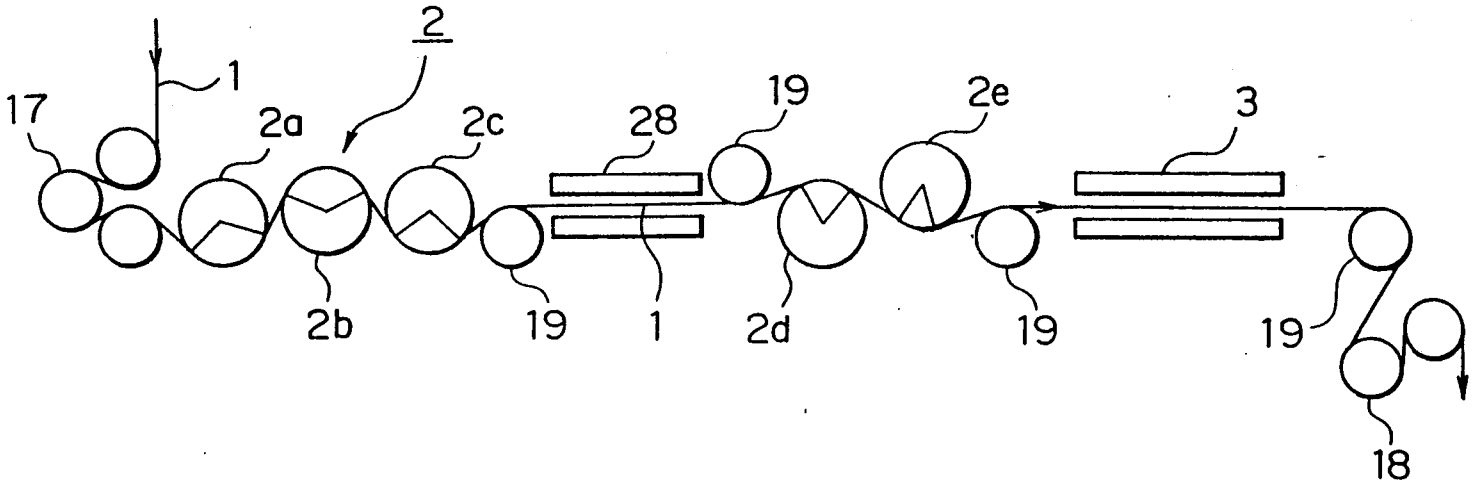
FIG. 18 is a descriptive view illustrating a fourth embodiment of the apparatus of the present invention.

FIG. 18 is a descriptive view illustrating a fourth embodiment of the apparatus of the present invention. As shown in FIG. 18, the apparatus of the fourth embodiment is identical with the apparatus of the second embodiment shown in FIG. 8, except that another gas cooler 28 for continuously cooling the steel strip 1 by blowing a cooling gas onto the surface of the steel strip 1 so as to achieve a uniform temperature distribution in the width direction of the steel strip 1 after the final cooling thereof, is arranged in the middle portion of the plurality of cooling rolls 2, i.e., between the first-half cooling rolls 2*a*, 2*b* and 2*c* and the latter-half cooling rolls 2*d* and 2*e*.

Figure 19:
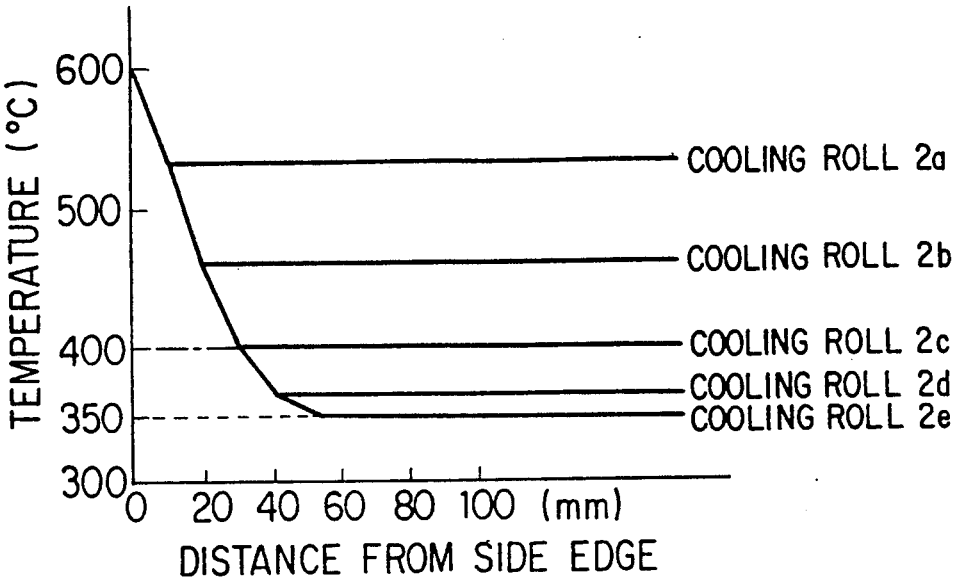
FIG. 19 is a graph illustrating a temperature distribution of a steel strip in the width direction thereof, when continuously cooling the steel strip by means of the apparatus of the fourth embodiment of the present invention.

FIG. 19 is a graph illustrating a temperature distribution of a steel strip 1 in the width direction thereof, when continuously cooling the steel strip 1 under the same conditions as in the first embodiment by means of the apparatus of the fourth embodiment of the present invention as shown in FIG. 18. In FIG. 19, the abscissa represents a distance from the side edge of the steel strip 1 toward the center in the width direction thereof, and the ordinate represents a temperature in the width direction of the steel strip 1. As shown by the solid line in FIG. 19, the temperature of the steel strip 1 in the width direction thereof on the exit side of the cooling roll 2*a* is over the target temperature for cooling of 350° C. in a portion within about 50 mm from the side edge of the steel strip 1. On the exit side of the gas cooler 3, however, the steel strip 1 shows a uniform temperature of about 350° C. over the entire portion from the side edge to the center of the steel strip 1, as shown by the dotted line in FIG. 19. The one-point chain line in FIG. 19 represents a temperature of the steel strip 1 on the exit side of the another gas cooler 28.

Figure 20:
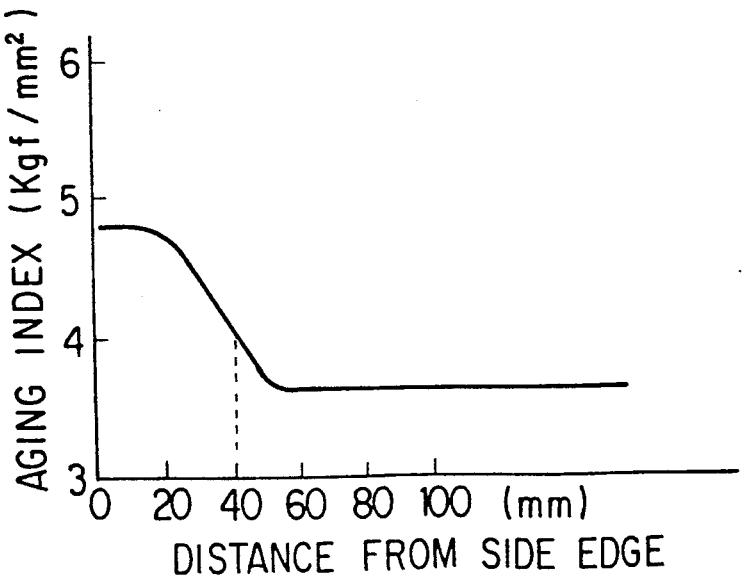
FIG. 20 is a graph illustrating an aging index (AI) of a steel strip in the width direction thereof, when continuously cooling the steel strip by means of the apparatus of the fourth embodiment of the present invention.

FIG. 20 is a graph illustrating an aging index (AI) of the above-mentioned steel strip 1 in the width direction thereof. In FIG. 20 the abscissa represents a distance from the side edge of the steel strip 1 toward the center in the width direction thereof, and the ordinate represents an aging index (AI). As is clear from FIG. 20, the portion showing an aging index of over 4 kgf/mm$^2$ covers only about 40 mm from the side edge of the steel strip 1, with a maximum aging index of 4.8 kgf/mm$^2$, thus the portion having an aging index of over 4 kgf/mm$^2$ is remarkably reduced.

Figure 21:
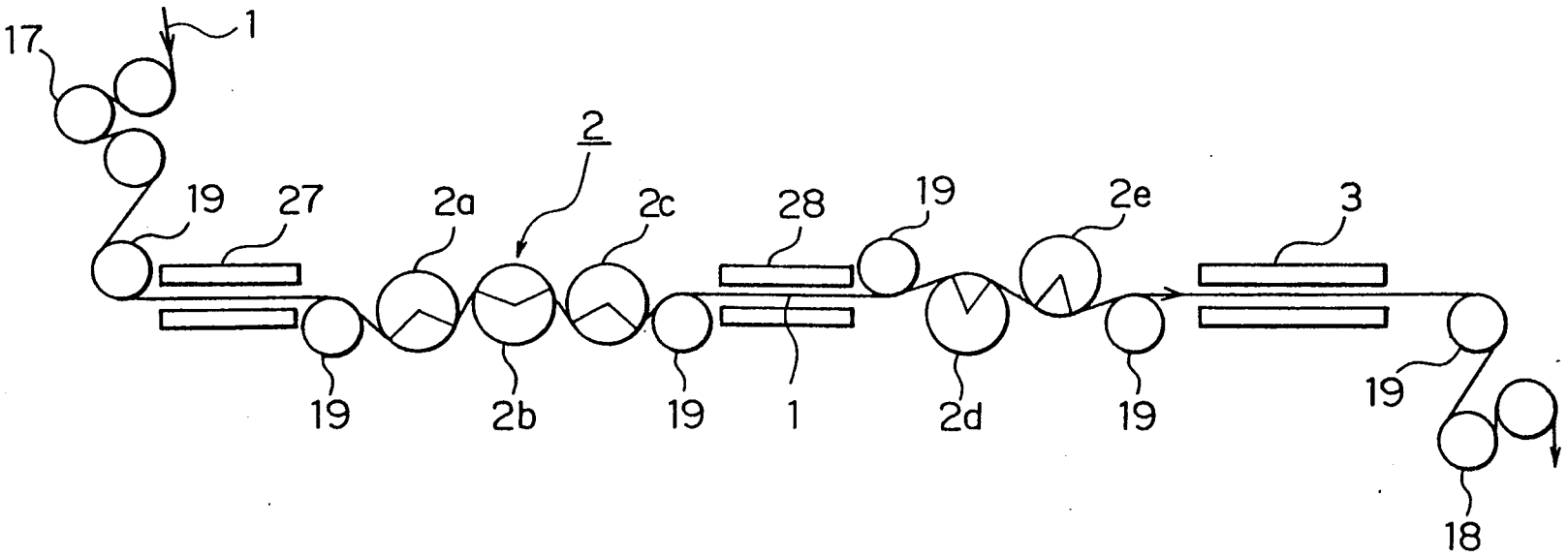
FIG. 21 is a descriptive view illustrating a fifth embodiment of the apparatus of the present invention.

FIG. 21 is a descriptive view illustrating a fifth embodiment of the apparatus of the present invention. As shown in FIG. 21, the apparatus of the fifth embodiment is identical with the apparatus of the second embodiment shown in FIG. 8, except that another gas cooler 27 for continuously cooling the steel strip 1 by blowing a cooling gas onto the surface of the steel strip 1 so as to achieve a uniform temperature distribution in the width direction of the steel strip 1 after the final cooling thereof, is arranged between the first tension regulator 17 and the plurality of cooling rolls 2, and further another gas cooler 28 for continuously cooling the steel strip 1 by blowing a cooling gas onto the surface of the steel strip 1 so as to achieve a uniform temperature distribution in the width direction of the steel strip 1 after the final cooling thereof, is arranged in the middle portion of the plurality of cooling rolls 2, i.e., between the first-half cooling rolls 2*a*, 2*b* and 2*c* and the latter-half cooling rolls 2*d* and 2*e*.

Figure 22:
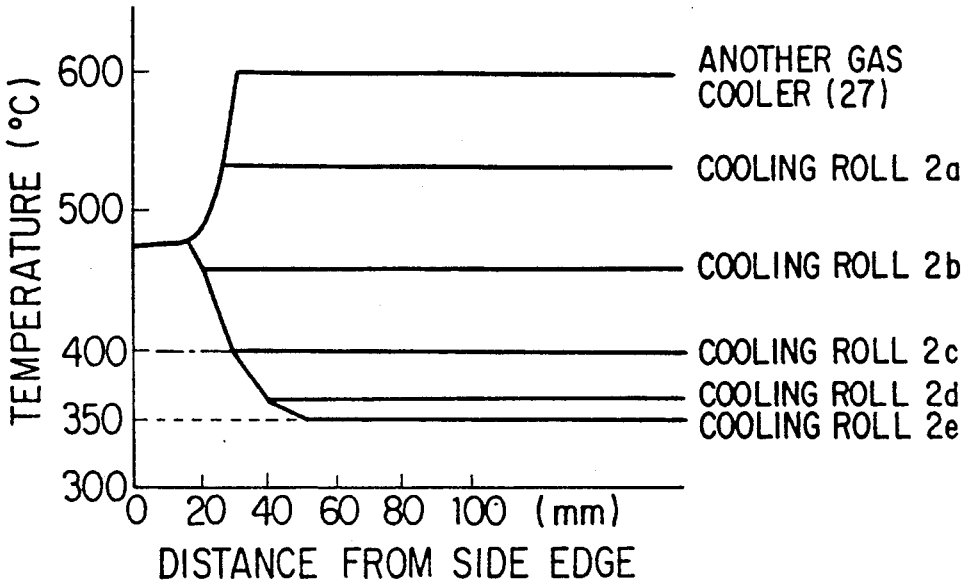
FIG. 22 is a graph illustrating a temperature distribution of a steel strip in the width direction thereof, when continuously cooling the steel strip by means of the apparatus of the fifth embodiment of the present invention.

FIG. 22 is a graph illustrating a temperature distribution of a steel strip 1 in the width direction thereof, when continuously cooling the steel strip 1 under the same conditions as in the first embodiment by means of the apparatus of the fifth embodiment of the present invention as shown in FIG. 21. In FIG. 22, the abscissa represents a distance from the side edge of the steel strip 1 toward the center in the width direction thereof, and the ordinate represents a temperature in the width direction of the steel strip 1. As shown by the solid line in FIG. 22, the temperature of the steel strip 1 in the width direction thereof on the exit side of the cooling roll 2*e* is over the target temperature for cooling of 350° C. in a portion within about 50 mm from the side edge of the steel strip 1. On the exit side of the gas cooler 3, however, the steel strip 1 shows a uniform temperature of about 350° C. over the entire portion from the side edge to the center of the steel strip 1, as shown by the dotted line in FIG. 22. The one-point chain line in FIG. 22 represents a temperature of the steel strip 1 on the exit side of the further another gas cooler 28.

Figure 23:
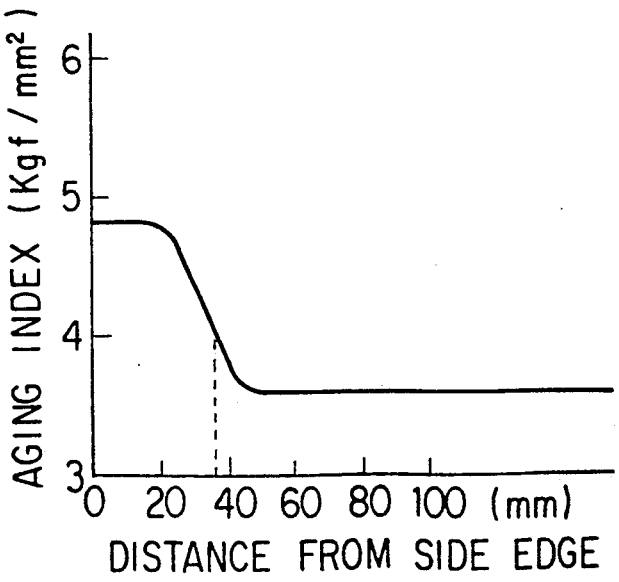
FIG. 23 is a graph illustrating an aging index (AI) of a steel strip in the width direction thereof, when continuously cooling the steel strip by means of the apparatus of the fifth embodiment of the present invention.

FIG. 23 is a graph illustrating an aging index (AI) of the above-mentioned steel strip 1 in the width direction thereof. In FIG. 23 the abscissa represents a distance from the side edge of the steel strip 1 toward the center in the width direction thereof, and the ordinate represents an aging index (AI). As is clear from FIG. 23, the portion showing an aging index of over 4 kgf/mm$^2$ covers only about 35 mm from the side edge of the steel strip 1, with a maximum aging index of 4.8 kgf/mm$^2$, thus the portion having an aging index of over 4 kgf/mm$^2$ is remarkably reduced.

Figure 24:
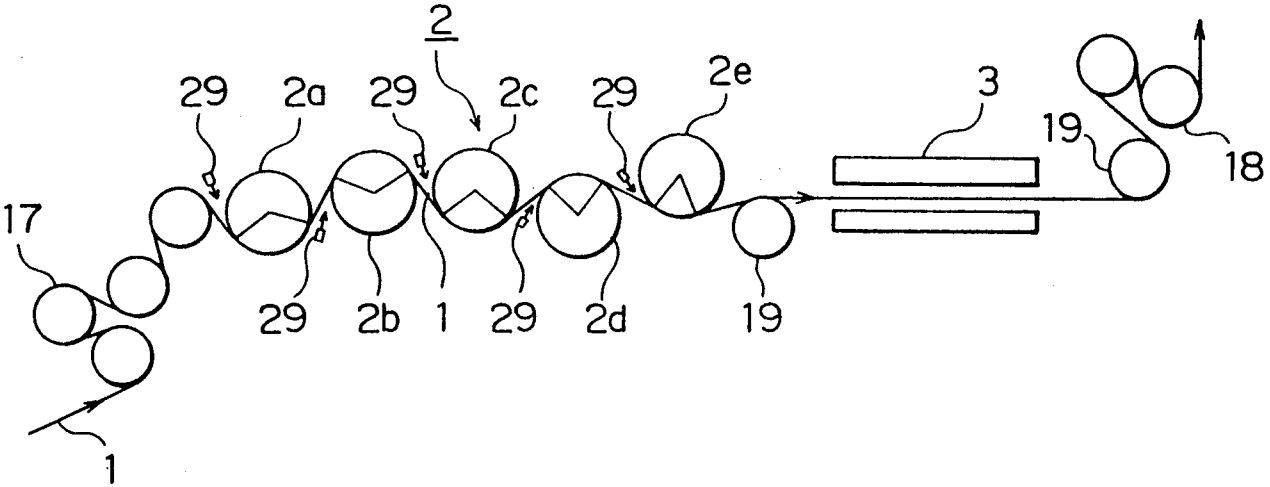
FIG. 24 is a descriptive view illustrating a sixth embodiment of the apparatus of the present invention.

FIG. 24 is a descriptive view illustrating a sixth embodiment of the apparatus of the present invention. As shown in FIG. 24, the apparatus of the sixth embodiment is identical with the apparatus of the second embodiment shown in FIG. 8, except that a plurality of gas blowing nozzles 29, which are directed toward a contact face between the surface of each of the plurality of cooling rolls 2 and the surface of the steel strip 1, are provided on the side of the cooling rolls 2.

Figure 25:
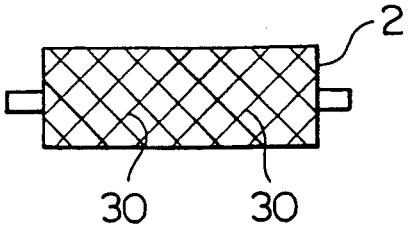
FIG. 25 is a schematic front view illustrating a typical cooling roll used in the apparatus of the sixth embodiment of the present invention.

The plurality of gas blowing nozzles 29 are provided stationarily or displaceably in the longitudinal direction of each of the cooling rolls 2, at prescribed intervals in the longitudinal direction of each of the cooling rolls 2. Each of the plurality of gas blowing nozzles 29 continuously cools the steel strip 1 by blowing a cooling gas onto the surface of the steel strip 1 so as to achieve a uniform temperature distribution in the width direction of the steel strip 1 after the final cooling thereof. As shown in a schematic front view of FIG. 25, shallow grooves 30 for passing the blown cooling gas should preferably be provided on the surface of each of the plurality of cooling rolls 2 used in the apparatus of the sixth embodiment.

Figure 26:
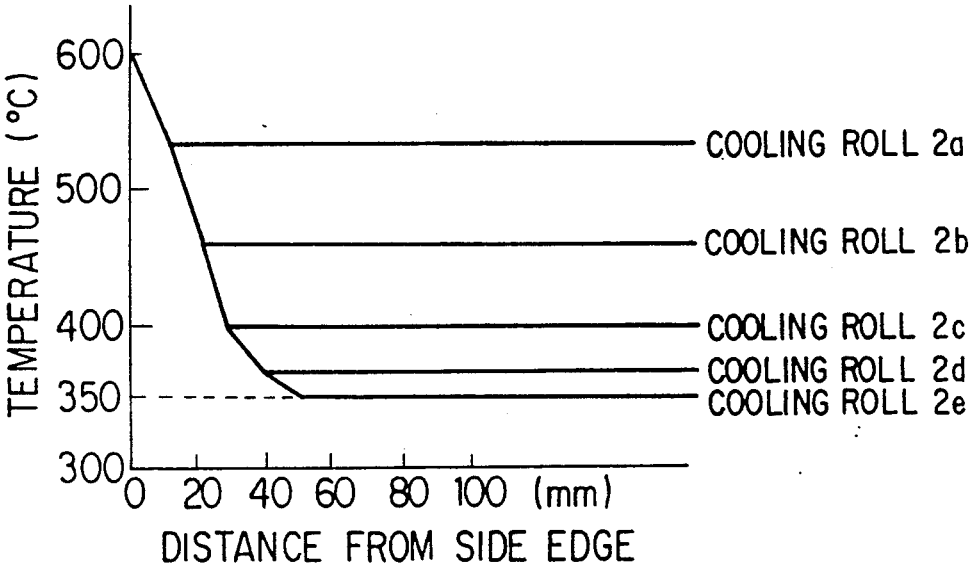
FIG. 26 is a graph illustrating a temperature distribution of a steel strip in the width direction thereof, when continuously cooling the steel strip by means of the apparatus of the sixth embodiment of the present invention.

FIG. 26 is a graph illustrating a temperature distribution of a steel strip 1 in the width direction thereof, when continuously cooling the steel strip 1 under the same conditions as in the first embodiment by means of the apparatus of the sixth embodiment of the present invention as shown in FIG. 24. In FIG. 26, the abscissa represents a distance from the side edge of the steel strip 1 toward the center in the width direction thereof, and the ordinate represents a temperature in the width direction of the steel strip 1. As shown by the solid line in FIG. 26, the temperature of the steel strip 1 in the width direction thereof on the exit side of the cooling roll 2*e* is over the target temperature for cooling of 350° C. in a portion within about 55 mm from the side edge of the steel strip 1. On the exit side of the gas cooler 3, however, the steel strip 1 shows a uniform temperature of about 350° C. over the entire portion from the side edge to the center of the steel strip 1, as shown by the dotted line in FIG. 26.

Figure 27:
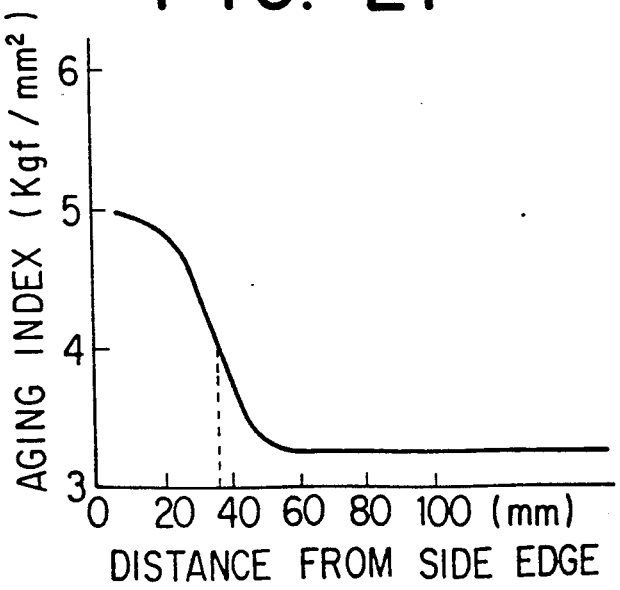
FIG. 27 is a graph illustrating an aging index (AI) of a steel strip in the width direction thereof, when continuously cooling the steel strip by means of the apparatus of the sixth embodiment of the present invention.

FIG. 27 is a graph illustrating an aging index (AI) of the above-mentioned steel strip 1 in the width direction thereof. In FIG. 27 the abscissa represents a distance form the side edge of the steel strip 1 toward the center in the width direction thereof, and the ordinate represents an aging index (AI). As is clear from FIG. 27, the portion showing an aging index of over 4 kgf/mm$^2$ covers only about 35 mm from the side edge of the steel strip 1, with a maximum aging index of 5.0 kgf/mm$^2$, thus the portion having an aging index of over 4 kgf/mm$^2$ is remarkably reduced.

Figure 28:
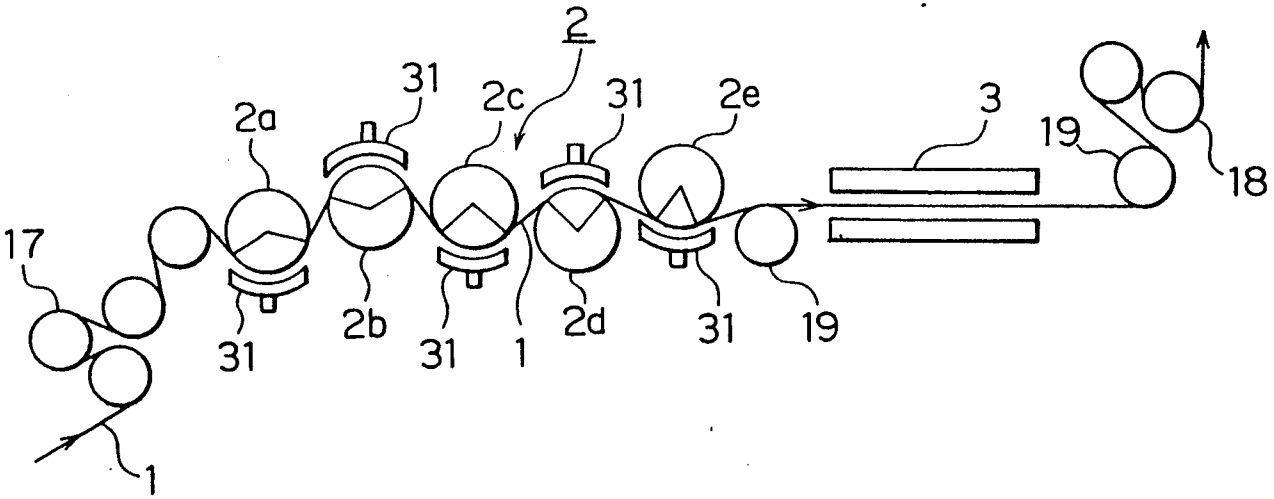
FIG. 28 is a descriptive view illustrating a seventh embodiment of the apparatus of the present invention.

FIG. 28 is a descriptive view illustrating a seventh embodiment of the apparatus of the present invention. As shown in FIG. 28, the apparatus of the seventh embodiment is identical with the apparatus of the second embodiment shown in FIG. 8, except that a plurality of gas blowing nozzles 31, which are directed toward a contact face between the surface of each of the plurality of cooling rolls 2 and the surface of the steel strip 1, are provided on the side of the steel strip 1.

FIG. 29(A) is a schematic side view illustrating a typical apparatus of the seventh embodiment of the present invention. As shown in FIG. 29(A), each of the plurality of gas blowing nozzles 31 comprises an arcuate nozzle header 32, provided on the side of the steel strip 1 toward a contact fact between the surface of each of the plurality of cooling rolls 2 and the surface of the steel strip 1, and a plurality of nozzles 33 provided at prescribed intervals on each of the arcuate nozzle headers 32.

Each of the arcuate nozzle headers 32 is displaceable toward the steel strip 1 by means of, for example, an air cylinder 34 so that a gap between the steel strip 1 and the gas blowing nozzle 31 can be adjusted. Each of the gas blowing nozzles 31 having such a construction is provided stationarily or displaceably in the longitudinal direction of each of the cooling rolls 2 at a prescribed interval.

Figure 29:
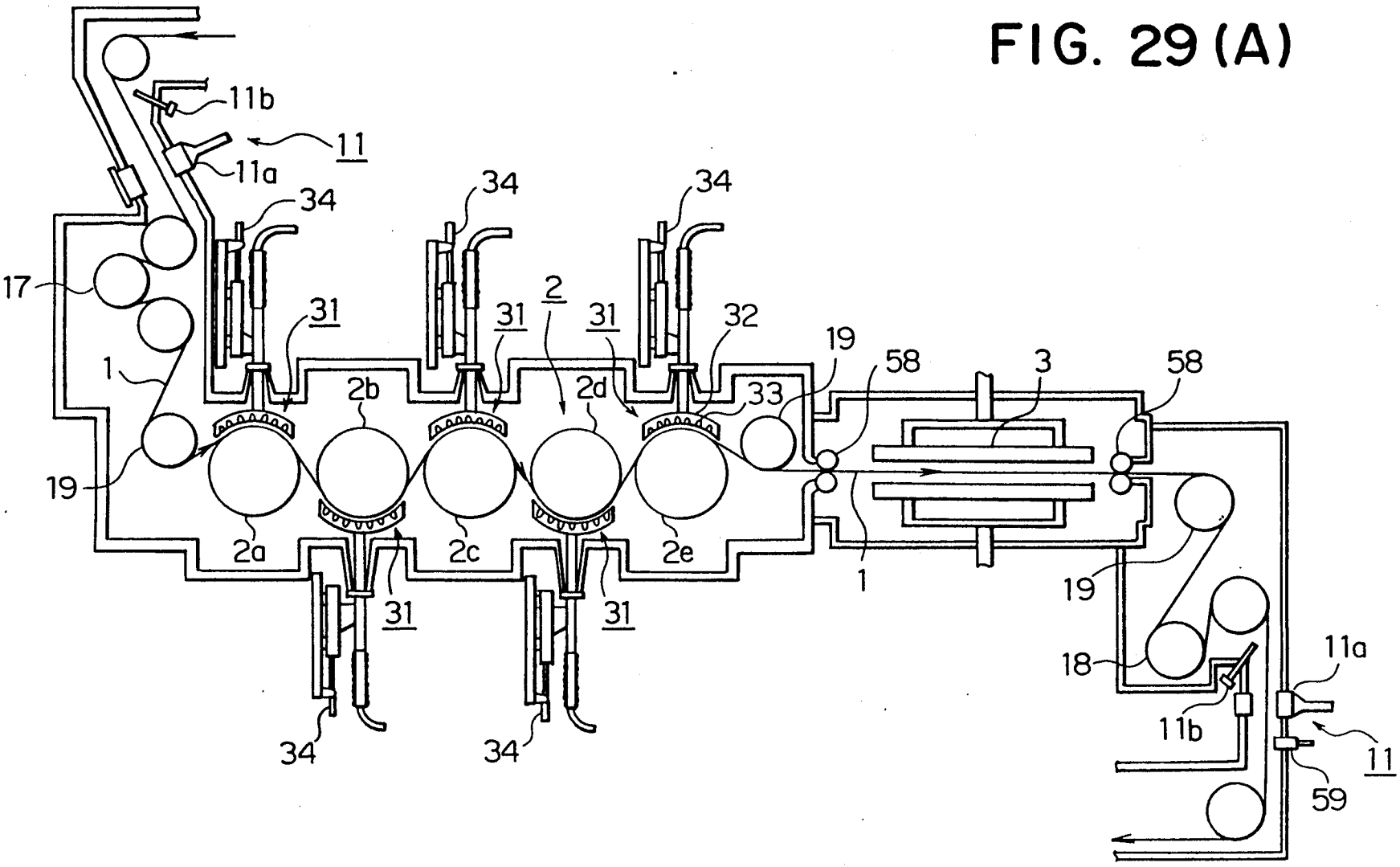
FIG. 29(A) is a schematic side view illustrating a typical apparatus of the seventh embodiment of the present invention.
FIG. 29(B) is a descriptive view illustrating the functions of a thermometer used in the apparatus of the seventh embodiment of the present invention.

The apparatus of the seventh embodiment is identical with the apparatus of the second embodiment in that the gas cooler 3 is arranged on the exit side of the plurality of cooling rolls 2, the first tension regulator 17 is arranged on the entry side of the plurality of cooling rolls 2, and the second tension regulator 18 is arranged on the exit side of the gas cooler 3. A radiation thermometer 11*a* and a multiple reflection thermometer 11*b* as the thermometer 11 are provided on each of the entry side of the first tension regulator 17 and the exit side of the second tension regulator 18. A temperature distribution of the steel strip 1 in the width direction thereof after the final cooling is continuously measured by means of the radiation thermometer 11*a* and the multiple reflection thermometer 11*b* provided on the exit side of the second tension regulator 18. The deflector roll 19 is provided on each of the entry side and the exit side of the gas cooler 3. In FIG. 29(*a*), 58 is a sealing roll provided at each of the entry and the exit of the gas cooler 3, and 59 is a movable partition plate.

Figure 29B:
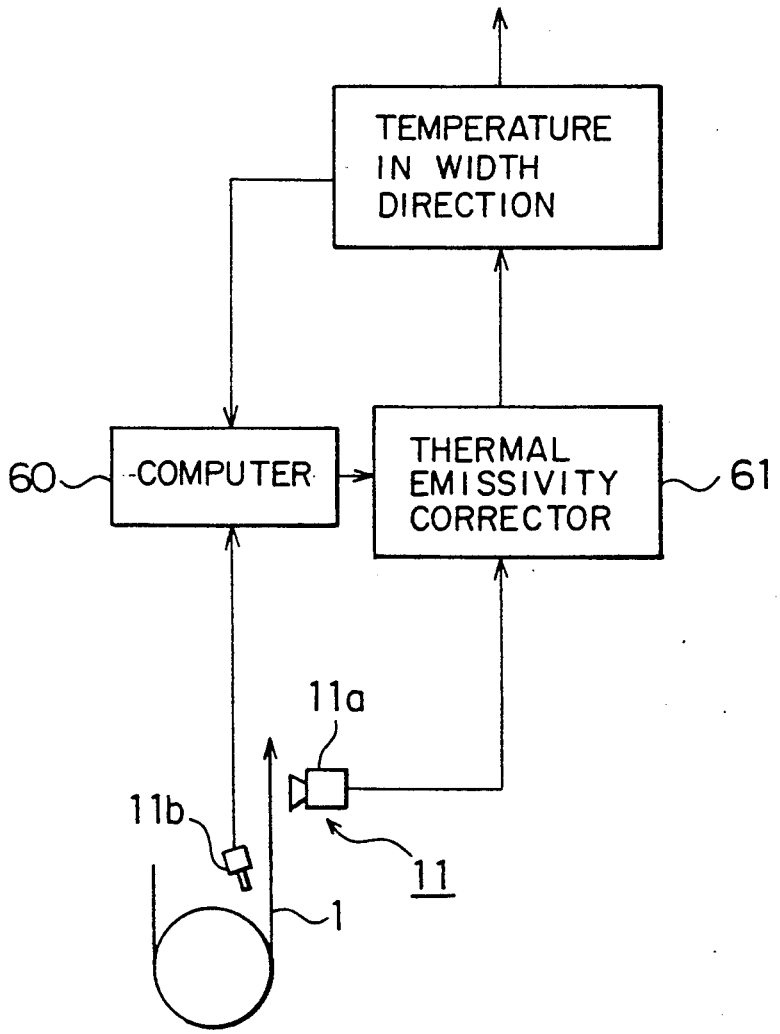

FIG. 29(B) is a descriptive view illustrating the functions of the radiation thermometer 11*a* and the multiple reflection thermometer 11*b* as the thermometer 11. The radiation thermometer 11*a* measures a radiation temperature of the steel strip 1 in the width direction thereof. The multiple reflection thermometer 11*b* measures a true temperature of the steel strip 1 on the surface thereof which is in contact with a roll. The true temperature of the steel strip 1 measured by the multiple reflection thermometer 11*b* is transmitted to a computer 60. The radiation temperature of the steel strip 1 measured by the radiation thermometer 11*a* is on the other hand transmitted to a thermal emissivity corrector 61. The thermal emissivity corrector 61 corrects the measured value of the radiation temperature of the steel strip 1 in the width direction thereof on the basis of the true temperature of the steel strip 1 from the calculator 60. The thus corrected radiation temperature of the steel strip 1 in the width direction thereof is transmitted to, for example, the first comparator 13 shown in FIG. 3.

Figure 30:
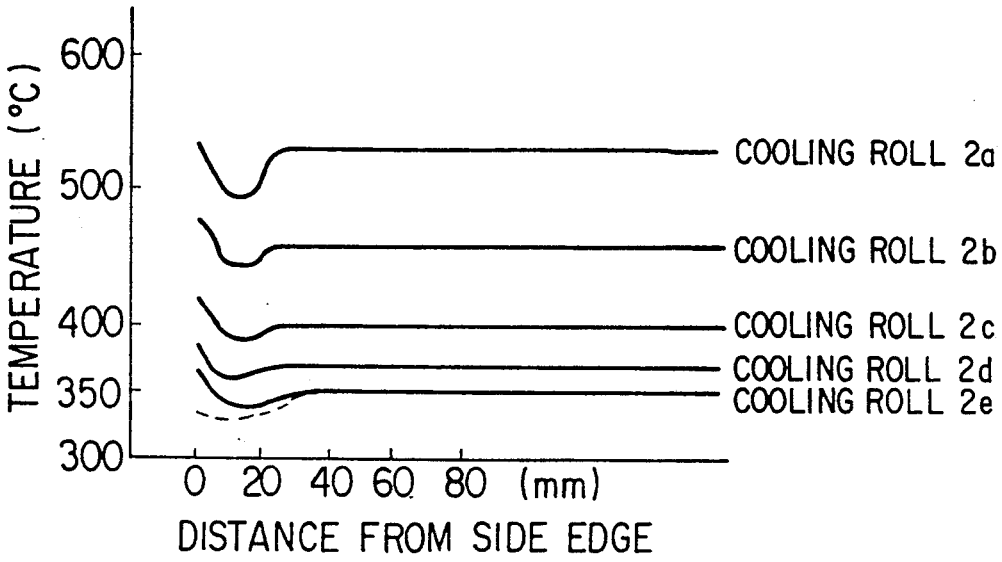
FIG. 30 is a graph illustrating a temperature distribution of a steel strip in the width direction thereof, when continuously cooling the steel strip by means of the apparatus of the seventh embodiment of the present invention.

FIG. 30 is a graph illustrating a temperature distribution of a steel strip 1 in the width direction thereof, when continuously cooling the steel strip 1 under the same conditions as in the first embodiment by means of the apparatus of the seventh embodiment of the present invention as shown in FIG. 28. In FIG. 30, the abscissa represents a distance from the side edge of the steel strip 1 toward the center in the width direction thereof, and the ordinate represents a temperature in the width direction of the steel strip 1. As shown by the solid line in FIG. 30, the temperature of the steel strip 1 in the width direction thereof on the exit side of the cooling roll 2*e* is about 380° C. at the side edge of the steel strip 1, and is substantially equal to the target temperature for cooling of 350° C. at a portion of about 10 mm from the side edge of the steel strip 1. On the exit side of the gas cooler 3, as shown by the dotted line in FIG. 30, the temperature of the steel strip 1 in the width direction thereof decreases to slightly lower than the target temperature for cooling of 350° C. at a position of about 10 mm from the side edge of the steel strip 1.

Figure 31:
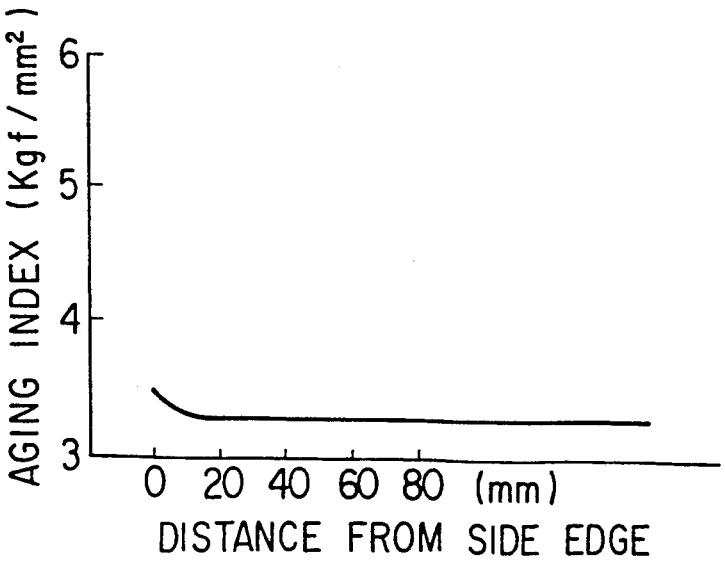
FIG. 31 is a graph illustrating an aging index (AI) of a steel strip in the width direction thereof, when continuously cooling the steel strip by means of the apparatus of the seventh embodiment of the present invention.

FIG. 31 is a graph illustrating an aging index (AI) of the above-mentioned steel strip 1 in the width direction thereof. In FIG. 31 the abscissa represents a distance from the side edge of the steel strip 1 toward the center in the width direction thereof, and the ordinate represents an aging index (AI). When cooling the steel strip 1 by means of the apparatus of the seventh embodiment, as is clear from FIG. 31, there is no portion showing an aging index of over 4 kgf/mm$^2$, and the aging index is very low at the both side edges of the steel strip 1.

Figure 32:
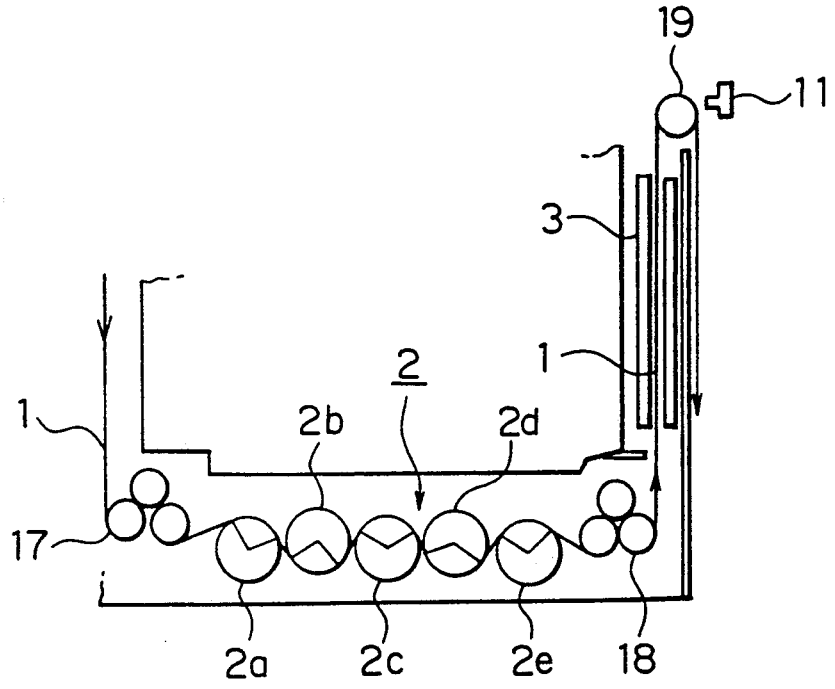
FIG. 32 is a descriptive view illustrating an eighth embodiment of the apparatus of the present invention.

FIG. 32 is a descriptive view illustrating an eighth embodiment of the apparatus of the present invention. As shown in FIG. 32, the apparatus of the eighth embodiment comprises a plurality of cooling rolls 2, which are freely rotatable and in contact with the steel strip 1 continuously travelling in the longitudinal direction thereof, for continuously cooling the steel strip 1, a gas cooler 3, arranged on the exit side of the plurality of cooling rolls 2, for continuously cooling the steel strip 1 by blowing a cooling gas onto the surface of the steel strip 1 so as to achieve a uniform temperature distribution in the width direction of the steel strip 1 after the final cooling thereof, a first tension regulator 17, comprising at least two bridle rolls, arranged on the entry side of the plurality of cooling rolls 2, and a second tension regulator 18, comprising at least two bridle rolls, arranged between the plurality of cooling rolls 2 and the gas cooler 3. In FIG. 32, 11 is a thermometer, provided on the exit side of the gas cooler 3, for continuously measuring a temperature distribution in the width direction of the steel strip 1 after the final cooling thereof, and 19 is a deflector roll.

Figure 33:
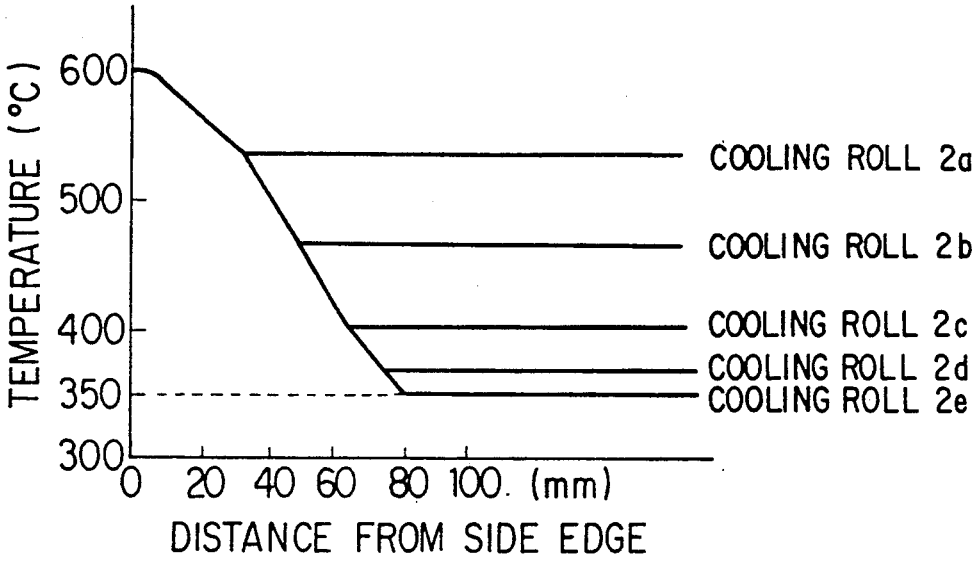
FIG. 33 is a graph illustrating a temperature distribution of a steel strip in the width direction thereof, when continuously cooling the steel strip by means of the apparatus of the eighth embodiment of the present invention.

FIG. 33 is a graph illustrating a temperature distribution of a steel strip 1 in the width direction thereof, when continuously cooling the steel strip 1 under the same conditions as in the first embodiment by means of the apparatus of the eighth embodiment of the present invention as shown in FIG. 32. In FIG. 33, the abscissa represents a distance from the side edge of the steel strip 1 toward the center in the width direction thereof, and the ordinate represents a temperature in the width direction of the steel strip 1. As shown by the solid line in FIG. 33, the temperature of the steel strip 1 in the width direction thereof on the exit side of the cooling roll 2*e* is over the target temperature for cooling of 350° C. in a portion within about 80 mm from the side edge of the steel strip 1. On the exit side of the gas cooler 3, however, the steel strip 1 shows a uniform temperature of about 350° C. over the entire portion from the side edge to the center of the steel strip 1, as shown by the dotted line in FIG. 33.

Figure 34:
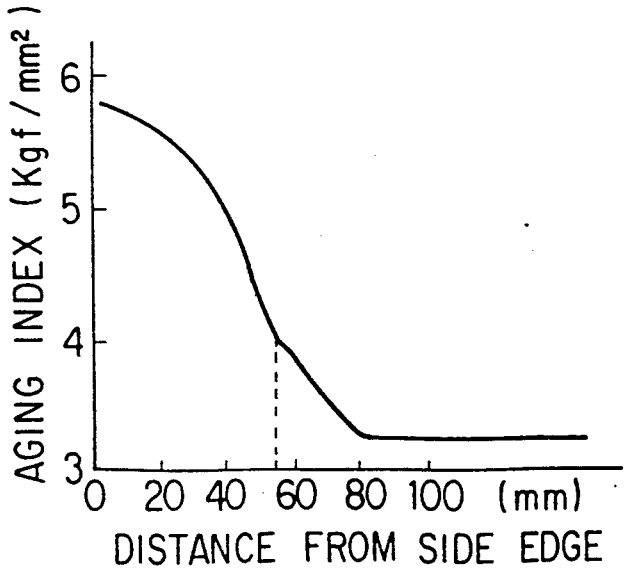
FIG. 34 is a graph illustrating an aging index (AI) of a steel strip in the width direction thereof, when continuously cooling the steel strip by means of the apparatus of the eighth embodiment of the present invention.

FIG. 34 is a graph illustrating an aging index (AI) of the above-mentioned steel strip 1 in the width direction thereof. In FIG. 34, the abscissa represents a distance from the side edge of the steel strip 1 toward the center in the width direction thereof, and the ordinate represents an aging index (AI). As is clear from FIG. 34, the portion showing an aging index of over 4 kgf/mm$^2$ covers only about 55 mm from the side edge of the steel strip 1, thus the portion having an aging index of over 4 kgf/mm$^2$ is remarkably reduced.

Figure 35:
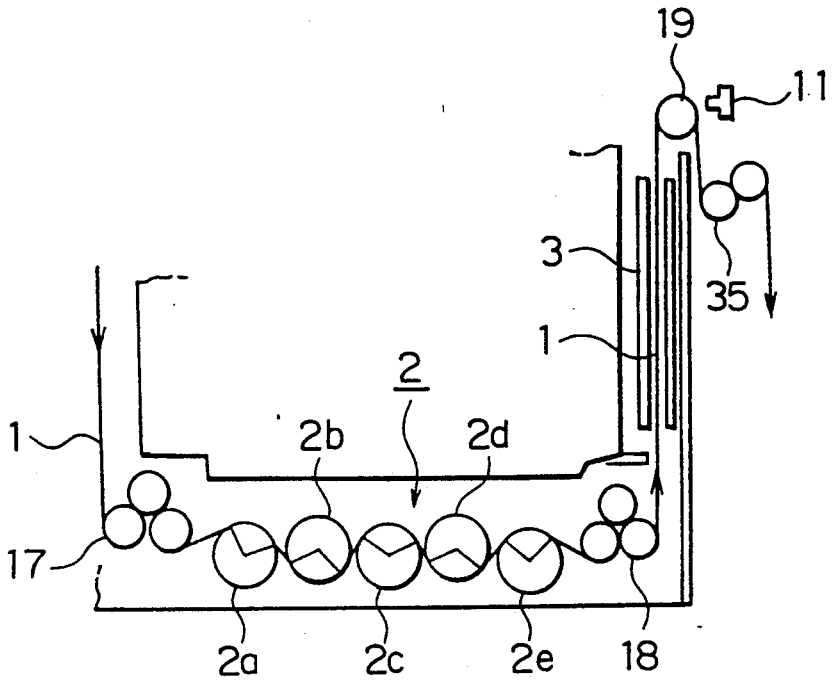
FIG. 35 is a descriptive view illustrating a ninth embodiment of the apparatus of the present invention.

FIG. 35 is a descriptive view illustrating a ninth embodiment of the apparatus of the present invention. As shown in FIG. 35, the apparatus of the ninth embodiment is identical with the apparatus of the eighth embodiment shown in FIG. 32, except that a third tension regulator 35 comprising at least two bridle rolls is further provided on the exit side of the gas cooler 3.

A temperature distribution and an aging index (AI) of a steel strip 1 in the width direction thereof, when continuously cooling the steel strip 1 by means of the apparatus of the ninth embodiment, is substantially the same as in the apparatus of the eighth embodiment, and a detailed description thereof is omitted.

Figure 36:
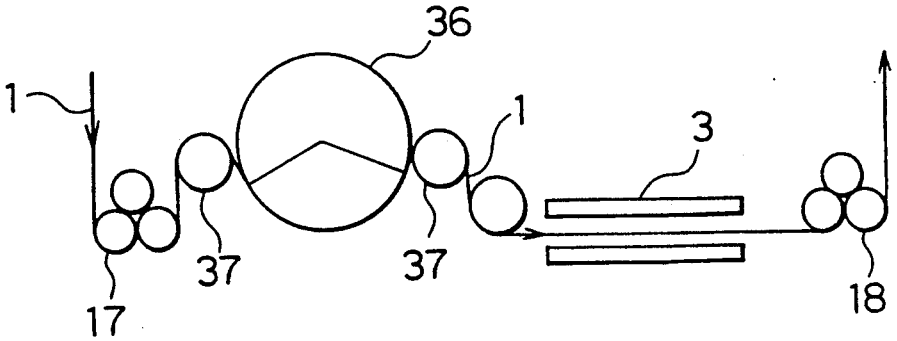
FIG. 36 is a descriptive view illustrating a tenth embodiment of the apparatus of the present invention.

FIG. 36 is a descriptive view illustrating a tenth embodiment of the apparatus of the present invention. As shown in FIG. 36, the apparatus of the tenth embodiment comprises a single cooling roll 36, which is freely rotatable and in contact with the steel strip 1 continuously travelling in the longitudinal direction thereof, for continuously cooling the steel strip 1, a gas cooler 3, arranged on the exit side of the single cooling roll 36, for continuously cooling the steel strip 1 by blowing a cooling gas onto the surface of the steel strip 1 so as to achieve a uniform temperature distribution in the width direction of the steel strip 1 after the final cooling thereof, a first tension regulator 17, comprising at least two bridle rolls, arranged on the entry side of the single cooling roll 36, and a second tension regulator 18, comprising at least two bridle rolls, arranged on the exit side of the gas cooler 3.

The single cooling roll 36 is stationary relative to the steel strip 1. The single cooling roll 36 has a length at least equal to the width of the steel strip 1, and a cooling liquid flows through the interior of the single cooling roll 36 to continuously cool the single cooling roll 36. A guide roll 37 for controlling a contact area between the surface of the single cooling roll 36 and the surface of the steel strip 1, is provided on each of the entry side and the exit side of the single cooling roll 36. Each of the guide rolls 37 is displaceable along the outer periphery of the single cooling roll 36 by means of a driving mechanism not shown. It is possible to control the contact are between the surface of the single cooling roll 36 and the surface of the steel strip 1, by causing each of the guide rolls 37 to displace along the outer periphery of the single cooling rolls 36.

Figure 37:
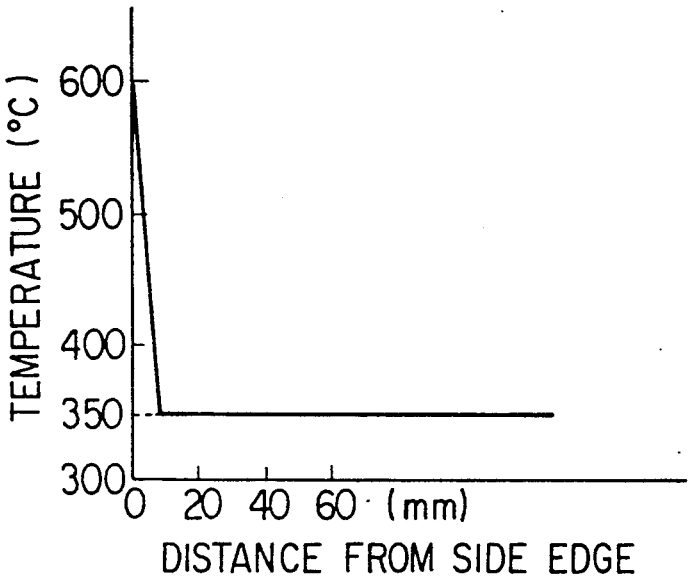
FIG. 37 is a graph illustrating a temperature distribution of a steel strip in the width direction thereof, when continuously cooling the steel strip by means of the apparatus of the tenth embodiment of the present invention.

FIG. 37 is a graph illustrating a temperature distribution of a steel strip 1 in the width direction thereof, when continuously cooling the steel strip 1 under the same conditions as in the first embodiment by means of the apparatus of the tenth embodiment of the present invention as shown in FIG. 36. In FIG. 37, the abscissa represents a distance from the side edge of the steel strip 1 toward the center in the width direction thereof, and the ordinate represents a temperature in the width direction of the steel strip 1. As shown by the solid line in FIG. 37, the temperature of the steel strip 1 in the width direction thereof on the exit side of the single cooling roll 36 is over the target temperature for cooling of 350° C. in a portion within about 10 mm from the side edge of the steel strip 1. On the exit side of the gas cooler 3, however, the steel strip 1 shows a uniform temperature of about 350° C. over the entire portion from the side edge to the center of the steel strip 1, as shown by the dotted line in FIG. 37.

Figure 38:
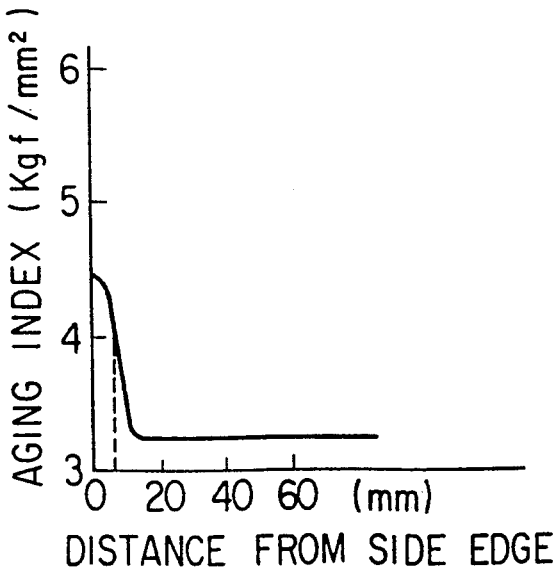
FIG. 38 is a graph illustrating an aging index (AI) of a steel strip in the width direction thereof, when continuously cooling the steel strip by means of the apparatus of the tenth embodiment of the present invention.

FIG. 38 is a graph illustrating an aging index (AI) of the above-mentioned steel strip 1 in the width direction thereof. In FIG. 38, the abscissa represents a distance from the side edge of the steel strip 1 toward the center in the width direction thereof, and the ordinate represents an aging index (AI). As is clear from FIG. 38, the portion showing an aging index of over 4 kgf/mm$^2$ covers only about 10 mm from the side edge of the steel strip 1 with a maximum aging index of 4.5 kgf/mm$^2$, thus the portion having an aging index of over 4 kgf/mm$^2$ is remarkably reduced.

Figure 39A:
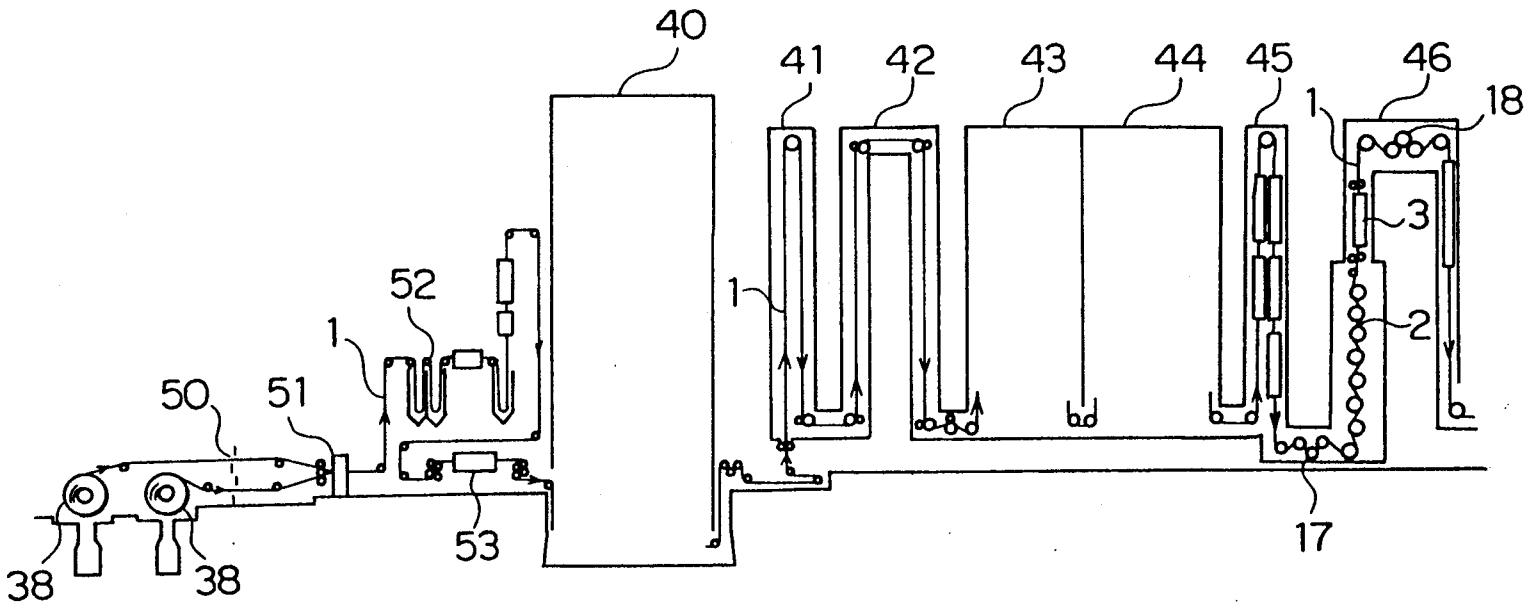
FIGS. 39(A) and 39(B) are flow diagrams illustrating a typical continuous annealing equipment incorporating the apparatus of the second embodiment of the present invention.
Figure 39B:
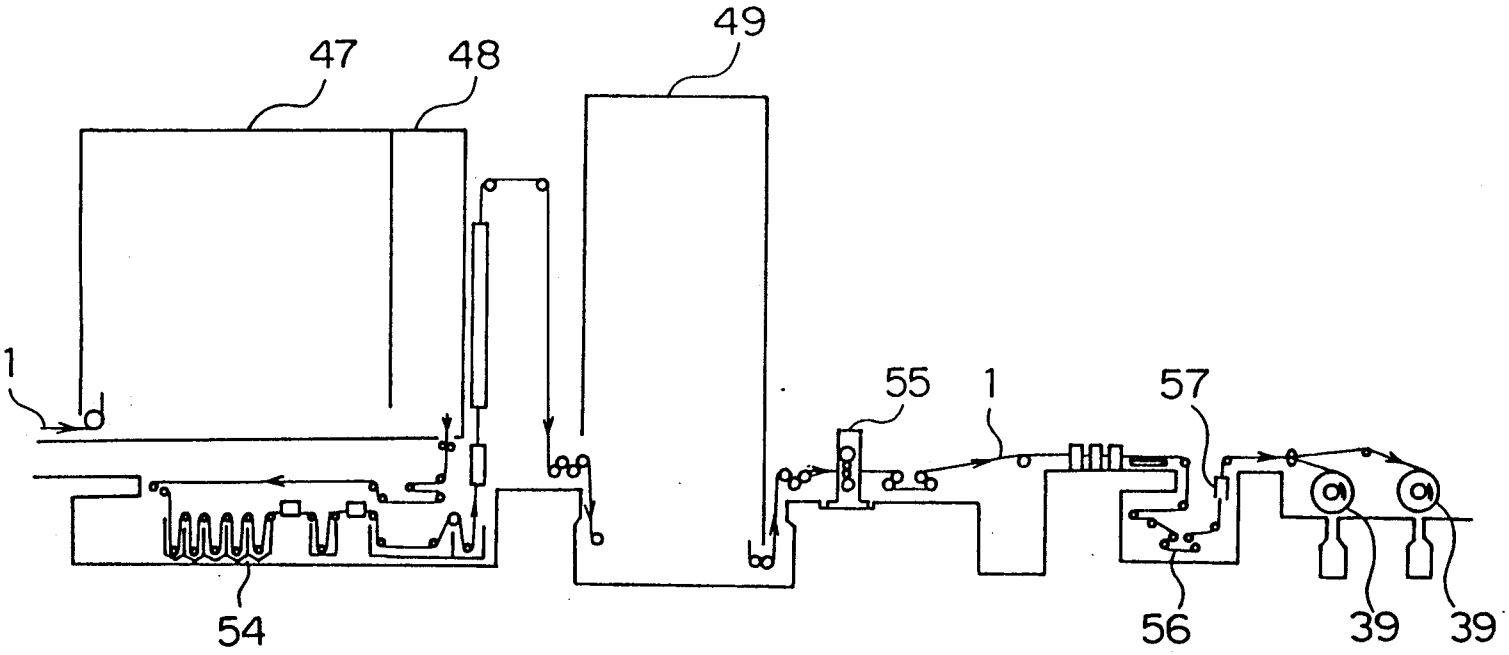

FIGS. 39(A) and 39(B) are flow diagrams illustrating a typical continuous annealing equipment of a steel strip incorporating the apparatus of the second embodiment of the present invention. As shown in FIGS. 39(A) and 39(B), an entry side looper 40, a preheating zone 41, a direct heating zone 42, an indirect heating zone 43, a soaking zone 44, a slow cooling zone 45, a first cooling zone 46 comprising the apparatus of the second embodiment of the present invention, an overaging zone (or a tempering zone; the same applies also hereafter) 47, a second cooling zone 48, and an exit side looper 49 are arranged in this order between a plurality of uncoilers 38 and a plurality of coilers 39.

In the first cooling zone 46 comprising the apparatus of the second embodiment of the present invention, a first tension regulator 17, a plurality of cooling rolls 2, a gas cooler 3, and a second tension regulator 18 are arranged in this order.

Between the second cooling zone 48 on the exit side of the overaging zone 47 and the exit side looper 49, there is arranged a chemical pretreatment zone 54 for forming a film of nickel or a nickel alloy in a slight amount and an oxide film in a slight amount on the surface of the continuously annealed steel strip 1 to improve chemical treatability and/or lubricity of the steel strip 1. Between the exit side looper 49 and the plurality of coilers 39, a temper rolling mill 55, a trimmer 56 and an oiler 57 are arranged in this order.

The steel strip 1 continuously travelling in the longitudinal direction thereof, which has been uncoiled by the uncoiler 38, cut at both ends in the longitudinal direction thereof by a cutter 50, and butt-welded at end faces by a welder 51, is then cleaned on the both surfaces thereof in a cleaner 52, then guided to a leveller 53 which levels the steel strip 1 so as to achieve a flat shape. This permit prevention of an abnormal travelling caused by a zigzag motion of the steel strip 1 in the entry side looper 40, the preheating zone 41, the direct heating zone 42, the indirect heating zone 43, the soaking zone 44, etc., and contact between the steel strip 1 and the furnace wall or the burner.

The steel strip 1 the shape of which has been levelled by the leveller 53 is introduced through the entry side looper 40 sequentially into the preheating zone 41, the direct heating zone 42, the indirect heating zone, the soaking zone 44 and the slow cooling zone 45. In the meantime, the steel strip 1 is preheated, directly heated, indirectly heated, soaked, and then slowly cooled in accordance with a prescribed heat cycle. Through the above-mentioned preheating, direct heating, indirect heating and soaking, the steel strip 1 is uniformly heated to a prescribed temperature with only a few irregularities in heating or thermal deformations.

Particularly, since the steel strip 1 is rapidly heated in the above-mentioned direct heating zone 42, the steel strip 1 passes through an unstable thermal deformation region in a very short period of time. Therefore, the steel strip 1 is less susceptible to the thermal deformation tending to occur during heating, and a zigzag motion of the steel strip 1 travelling through the direct heating zone 42 is prevented.

The steel strip 1 slowly cooled to a prescribed temperature in the slow cooling zone 45 is then introduced into the first cooling zone 46. In the first cooling zone 46, the steel strip 1 is continuously cooled by the plurality of cooling rolls 2, and then continuously cooled by the gas cooler 3 so as to achieve a uniform temperature distribution in the width direction of the steel strip 1 after the final cooling thereof. Because the steel strip 1 has been levelled into a flat shape by the leveller 53, an insufficient contact of the steel strip 1 with the plurality of cooling rolls 2 is prevented.

The steel strip 1 cooled to a prescribed temperature in the first cooling zone 46 is then introduced into the overaging zone 47, in which an overaging treatment is applied to the steel strip 1. Since the steel strip 1 has been cooled in the above-mentioned first cooling zone 46 so as to achieve a uniform temperature distribution in the width direction of the steel strip 1 after the final cooling thereof, a defective shape such as edge waves or heat buckles does not occur in the steel strip 1, and as a result, an abnormal travelling such as a zigzag motion never occurs in the steel strip 1 which travels through the overaging zone 47 as the next process.

The steel strip 1 overaged in the overaging zone 47 and cooled to a temperature not causing oxidation in the second cooling zone 48 is then introduced into the chemical pretreatment zone 54, in which a film of nickel or a nickel alloy in a slight amount is formed on the surface of the steel strip 1 through a cathodic electrolysis treatment, and then, an oxide film in a slight amount is formed on the nickel or nickel alloy film through a dipping treatment in a neutral or alkaline bath.

Figure 40A:
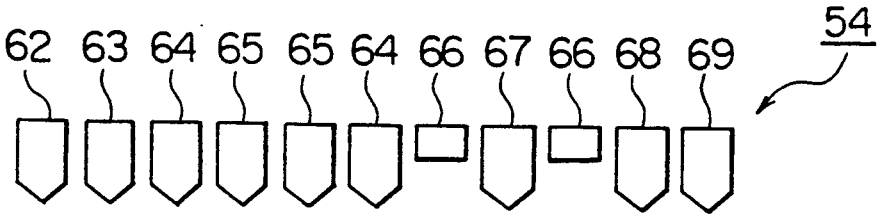
FIGS. 40(A), 40(B) and 40(C) are schematic flow diagrams each illustrating a typical chemical pretreatment zone in the continuous annealing equipment.
Figure 40B:
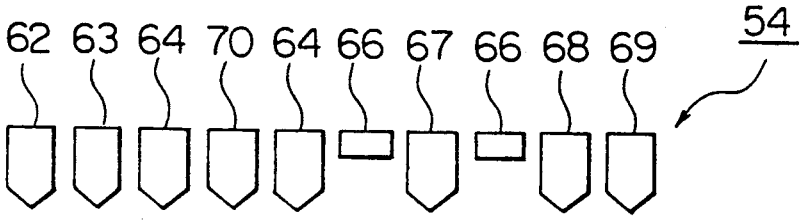
Figure 40C:
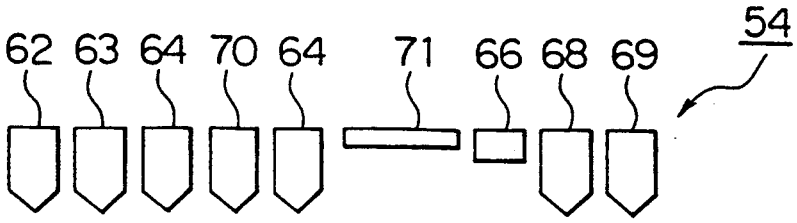
Figure 41:
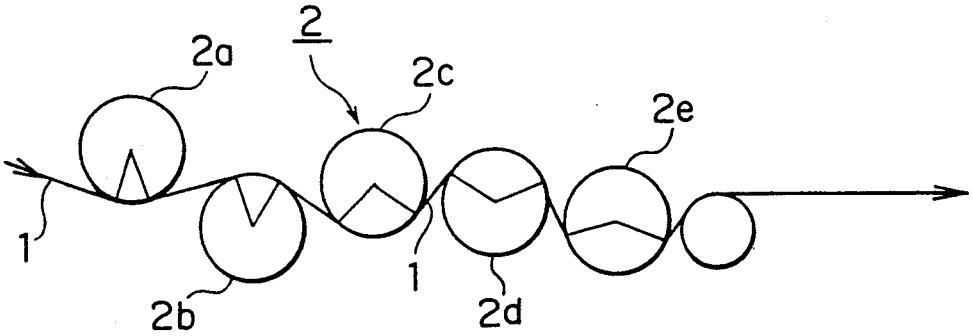
FIG. 41 is a descriptive view illustrating a typical apparatus for continuously cooling a metal strip, for example, a steel strip based on the prior art.
Figure 42:
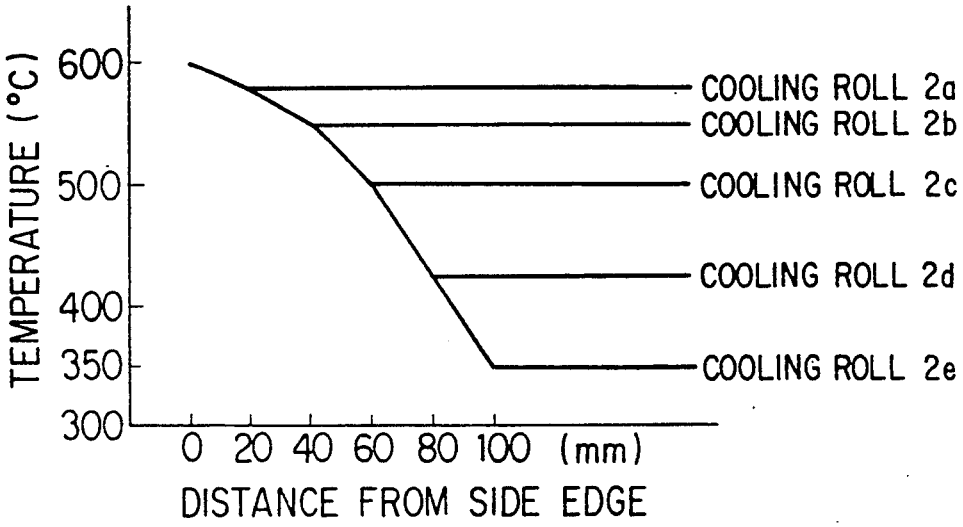
FIG. 42 is a graph illustrating a temperature distribution of a steel strip in the width direction thereof, when continuously cooling the steel strip by means of the cooling apparatus of the prior art.
Figure 43:
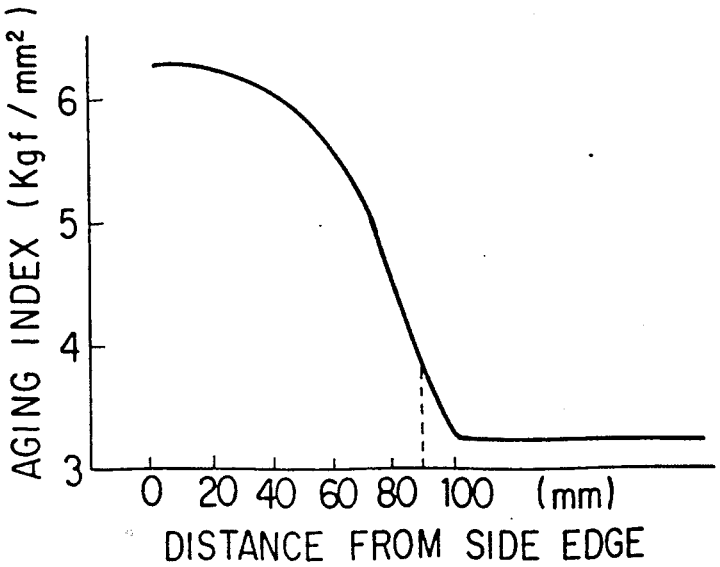
FIG. 43 is a graph illustrating an aging index (AI) of a steel strip in the width direction thereof, when continuously cooling the steel strip by means of the cooling apparatus of the prior art.

FIGS. 40(A), 40(B) and 40(C) are schematic flow diagrams each illustrating a typical chemical pretreatment zone 54. In the embodiment shown in FIG. 40(A), the chemical pretreatment zone 54 comprises a cooling tank 62, a pickling tank 63, a water rinsing tank 64, a nickel-phosphorus alloy plating tank 65, another water rinsing tank 64, a scrubber 66, a neutralizing tank 67, another scrubber 66, a hot-water tank 68, and a cold water tank 69. The steel strip 1 is introduced through the cooling tank 62, the pickling tank 63 and the water rinsing tank 64 into the nickel-phosphorus alloy plating tank 65, in which a nickel-phosphorus alloy film in a slight amount is formed on the surface of the steel strip 1 through a cathodic electrolysis treatment. The steel strip on the surface of which the nickel-phosphorus alloy plating film has thus been formed is then introduced through the another water rinsing tank 64, the scrubber 66, the neutralizing tank 67 and the another scrubber 66 into the hot water tank 68 and the cold water tank 69, in which an oxide film in a slight amount is formed on the nickel-phosphorus alloy plating film.

The embodiment shown in FIG. 40(B) is identical with that shown in FIG. 40(A), except that a nickel plating tank 70 is provided in place of the above-mentioned nickel-phosphorus alloy plating tank 65. The embodiment shown in FIG. 40(C) is identical with that shown in FIG. 40(B), except that a water spray tank 71 is provided in place of the above-mentioned scrubber 66 and neutralizing tank 67.

The continuously annealed steel strip 1 has a beautiful surface as a result of a direct flame reducing heating applied in the direct heating zone 42, a heating in a weakly reducing atmosphere applied in the indirect heating zone 43 and the soaking zone 44, and a non-oxidizing cooling applied in the first cooling zone 46. However, the steel strip 1 is not always satisfactory in chemical treatability and/or lubricity. This problem is solved by forming a nickel or nickel alloy film in a slight amount and an oxide film in a slight amount on the surface of the steel strip 1 in the chemical pretreatment zone 54 as described above, thus permitting improvement of chemical treatability and/or lubricity of the steel strip 1.

The steel strip 1 to which the above-mentioned pretreatment has been applied in the chemical pretreatment zone 54 is then introduced through the exit side looper 49 into the temper rolling mill 55, in which a temper rolling is applied to the steel strip 1. Then, the side edges of the steel strip 1 are trimmed by the trimmer 56. After application of a anticorrosive oil by the oiler 57, the steel strip 1 is coiled by the coiler 39 into a coil.

Since the steel strip 1 after the final cooling thereof in the above-mentioned process has a uniform temperature distribution in the width direction thereof, the steel strip 1 has substantially a uniform aging index in the width direction thereof. It is therefore possible to manufacture a steel strip having uniform mechanical properties and excellent in quality.

The above description has mainly covered the apparatus of the present invention as to cooling which is applied when continuously annealing a steel strip comprising an ordinary aluminum-killed steel. However, the apparatus of the present invention is applicable also, for example, for cooling when continuously hardening or tempering a steel strip 1 comprising a high tensile steel, cooling when continuously annealing a steel strip 1 comprising an aluminum-killed steel containing at least one of titanium, niobium, zirconium, vanadium and boron in a slight amount to fix carbon or nitrogen in steel, cooling applied to a continuously annealed steel strip on the entry side of a hot-dip plating tank in a continuous hot-dip plating equipment, and cooling applied to a hot-dip plated steel strip on the exit side of a hot-dip plating tank.

According to the apparatus of the present invention, as described above in detail, it is possible to provide, when continuously cooling a metal strip continuously travelling in the longitudinal direction thereof by means of at least one cooling roll, an apparatus for continuously cooling a metal strip, which permits prevention of the occurrence of a defective shape such as edge waves or heat buckles in the metal in the metal strip and an abnormal travelling of the metal strip such as a zigzag motion in the next process, and makes available a high-quality metal strip having uniform mechanical properties in the width direction thereof, through achievement of a uniform temperature distribution in the width direction of the metal strip, thus providing industrially useful effects.

What is claimed is:

1. An apparatus for continuously cooling a metal strip, which comprises:

at least one cooling roll, which is freely rotatable and in contact with a metal strip continuously travelling in the longitudinal direction thereof, for continuously cooling said metal strip, said cooling roll have a length at least equal to the width of said metal strip, a cooling liquid flowing through the interior of said cooling roll to continuously cool same, and a contact area between the surface of said cooling roll and the surface of said metal strip being controllable;

a gas cooler, arranged on an exit side of said at least one cooling roll, for continuously cooling said metal strip by blowing a cooling gas onto the surface of said metal strip so as to achieve a uniform temperature distribution in the width direction of said metal strip after a final cooling thereof, said gas cooler being arranged in the width direction of said metal strip at a prescribed distance from each of both surfaces of said metal strip, said gas cooler comprising a plurality of mutually independent nozzle headers for blowing said cooling gas onto the surface of said metal strip, and said plurality of nozzle headers controlling at least one of a flow rate and a flow velocity of said cooling gas in the width direction of said metal strip; and a first tension regulator comprising at least two rolls, arranged on an entry side of said at least one cooling roll, and a second tension regulator comprising at least two rolls, arranged on the exit side of said gas cooler.

2. An apparatus as claimed in claim 1, wherein:

a thermometer, for continuously measuring a temperature distribution in the width direction of said metal strip after the final cooling thereof, is provided on the exit side of said gas cooler, and at least one of said flow rate and said flow velocity of said cooling gas blown from said plurality of nozzle headers of said gas cooler onto the surface of said metal strip, is controlled on the basis of said temperature distribution measured by said thermometer.

3. An apparatus as claimed in claim 1, wherein:

said gas cooler blows a gas comprising a hydrogen gas in an amount within a range of from 40 to 90 vol. % and a nitrogen gas in an amount within a range of from 10 to 60 vol. % onto the surface of said metal strip to cool said metal strip.

4. An apparatus as claimed in claim 1, wherein:

said at least one cooling roll comprises a plurality of cooling rolls, said cooling rolls having respective axes which are in parallel with each other, and each of said plurality of cooling rolls is displaceable toward said metal strip to control said contact area with said metal strip.

5. An apparatus as claimed in claim 4, wherein:

said contact area between the surface of each of first-half cooling rolls from among said plurality of cooling rolls and the surface of said metal strip, is larger than said contact area between the surfaces of each of latter-half cooling rolls from among said plurality of cooling rolls and the surface of said metal strip.

6. An apparatus as claimed in claim 4, further comprising:

another gas cooler, for continuously cooling said metal strip by blowing a cooling gas onto the surface of said metal strip so as to achieve a uniform temperature distribution in the width direction of said metal strip after the final cooling thereof, arranged between said first tension regulator and said plurality of cooling rolls.

7. An apparatus as claimed in claim 4, further comprising:

another gas cooler, for continuously cooling said metal strip by blowing a cooling gas onto the surface of said metal strip so as to achieve a uniform temperature distribution in the width direction of said metal strip after the final cooling thereof, arranged in the middle portion of said plurality of cooling rolls.

8. An apparatus as claimed in claim 4, further comprising:

another gas cooler, for continuously cooling said metal strip by blowing a cooling gas onto the surface of said metal strip so as to achieve a uniform temperature distribution in the width direction of said metal strip after the final cooling thereof, arranged between said first tension regulator and said plurality of cooling rolls, and a further gas cooler, for continuously cooling said metal strip by blowing a cooling gas onto the surface of said metal strip so as to achieve a uniform temperature distribution in the width direction of said metal strip after the final cooling thereof, arranged in the middle portion of said plurality of cooling rolls.

9. An apparatus as claimed in claim 4, wherein:

a plurality of gas blowing nozzles, which are directed toward a contact face between the surface of each of said plurality of cooling rolls and the surface of said metal strip, are provided on the side of said cooling rolls, and each of said plurality of gas blowing nozzles continuously cools said metal strip by blowing a cooling gas onto the surface of said metal strip so as to achieve a uniform temperature distribution in the width direction of said metal strip after the final cooling thereof.

10. An apparatus as claimed in claim 4, wherein:

a plurality of gas blowing nozzles, which are directed toward a contact face between the surface of each of said plurality of cooling rolls and the surface of said metal strip, are provided on the side of said metal strip, and each of said plurality of gas blowing nozzles continuously cools said metal strip by blowing a cooling gas onto the surface of said metal strip so as to achieve a uniform temperature distribution in the width direction of said metal strip after the final cooling thereof.

11. An apparatus as claimed in claim 1, wherein:

said at least one cooling roll comprises a single cooling roll which is stationary relative to said metal strip; and a guide roll for controlling said contact area between the surface of said single cooling roll and the surface of said metal strip, is provided on each of the entry side and the exit side of said single cooling roll, each of said guide rolls being displaceable along the outer periphery of said single cooling roll.

12. An apparatus for continuously cooling a metal strip, which comprises:

a plurality of cooling rolls, which are freely rotatable and in contact with a metal strip continuously travelling in the longitudinal direction thereof, for continuously cooling said metal strip, said plurality of cooling rolls having respective axes which are in parallel with each other and each of said plurality of cooling rolls having a length at least equal to the width of said metal strip, a cooling liquid flowing through the interior of said cooling roll to continuously cool same, and a contact area between the surface of said cooling roll and the surface of said metal strip being controllable;

a gas cooler, arranged on the exit side of said plurality of cooling rolls, for continuously cooling said metal strip by blowing a cooling gas onto the surface of said metal strip so as to achieve a uniform temperature distribution in the width direction of said metal strip after a final cooling thereof, said gas cooler being arranged in the width direction of said metal strip at a prescribed distance from each of both surfaces of said metal strip, said gas cooler comprising a plurality of mutually independent nozzle headers for blowing said cooling gas onto the surface of said metal strip, and said plurality of nozzle headers controlling at least one of a flow rate and a flow velocity of said cooling gas in the width direction of said metal strip; and a first tension regulator comprising at least two rolls, arranged on an entry side of said plurality of cooling rolls, and a second tension regulator comprising at least two rolls, arranged between said plurality of cooling rolls and said gas cooler.

13. An apparatus as claimed in claim 12, further comprising:

a third tension regulator comprising at least two rolls further arranged on the exit side of said gas cooler.

14. An apparatus as claimed in claim 12, wherein:

each of said plurality of cooling rolls in displaceable toward said metal strip to control said contact area with said metal strip.

15. An apparatus as claimed in claim 14, wherein:

a contact area between the surface of each of first-half cooling rolls from among said plurality of cooling rolls and the surface of said metal strip, is larger than a contact area between the surfaces of each of latter-half cooling rolls and the surface of said metal strip.

16. An apparatus as claimed in claim 12, further comprising:

another gas cooler, for continuously cooling said metal strip by blowing a cooling gas onto the surface of said metal strip so as to achieve a uniform temperature distribution in the width direction of said metal strip after the final cooling thereof, arranged between said first tension regulator and said plurality of cooling rolls.

17. An apparatus as claimed in claim 12, further comprising:

another gas cooler, for continuously cooling said metal strip by blowing a cooling gas onto the surface of said metal strip so as to achieve a uniform temperature distribution in the width direction of said metal strip after the final cooling thereof, arranged in the middle portion of said plurality of cooling rolls.

18. An apparatus as claimed in claim 12, further comprising:

another gas cooler, for continuously cooling said metal strip by blowing a cooling gas onto the surface of said metal strip so as to achieve a uniform temperature distribution in the width direction of said metal strip after the final cooling thereof, arranged between said first tension regulator and said plurality of cooling rolls; and a further gas cooler, for continuously cooling said metal strip by blowing a cooling gas onto the surface of said metal strip so as to achieve a uniform temperature distribution in the width direction of said metal strip after the final cooling thereof, arranged in the middle portion of said plurality of cooling rolls.

19. An apparatus as claimed in claim 12, wherein:

a plurality of gas blowing nozzles, which are directed toward a contact face between the surface of each of said plurality of cooling rolls and the surface of said metal strip, are provided on a side of said cooling rolls, and each of said plurality of gas blowing nozzles continuously cools said metal strip by blowing a cooling gas onto the surface of said metal strip so as to achieve a uniform temperature distribution in the width direction of said metal strip after the final cooling thereof.

20. An apparatus as claimed in claim 12, wherein:

a plurality of gas blowing nozzles, which are directed toward a contact face between the surface of each of said plurality of cooling rolls and the surface of said metal strip, are provided on the side of said metal strip, and each of said plurality of gas blowing nozzles continuously cools said metal strip by blowing a cooling gas onto the surface of said metal strip so as to achieve a uniform temperature distribution in the width direction of said metal strip after the final cooling thereof.

* * * * *